US008616295B2

(12) United States Patent
Laskaris et al.

(10) Patent No.: US 8,616,295 B2
(45) Date of Patent: Dec. 31, 2013

(54) INTEGRATED CONTROLS FOR A FIRE SUPRESSION SYSTEM

(75) Inventors: Michael A. Laskaris, Collegeville, PA (US); Dominic John Colletti, Royersford, PA (US); Gary Handwerk, Ocala, FL (US)

(73) Assignee: Hale Products, Inc., Conshohocken, PA (US)

( * ) Notice: Subject to any disclaimer, the term of this patent is extended or adjusted under 35 U.S.C. 154(b) by 207 days.

(21) Appl. No.: 13/161,761

(22) Filed: Jun. 16, 2011

(65) Prior Publication Data

US 2011/0240317 A1 Oct. 6, 2011

Related U.S. Application Data

(62) Division of application No. 12/421,132, filed on Apr. 9, 2009, now Pat. No. 7,987,916.

(60) Provisional application No. 61/043,436, filed on Apr. 9, 2008.

(51) Int. Cl.
*A62C 27/00* (2006.01)

(52) U.S. Cl.
USPC ..... 169/24; 239/172

(58) Field of Classification Search
USPC ..... 169/24, 56, 60, 52; 239/71, 172
See application file for complete search history.

(56) References Cited

U.S. PATENT DOCUMENTS 3,981,618 A 9/1976 Nelson, Jr.
4,162,714 A 7/1979 Correll
4,189,005 A 2/1980 McLoughlin
5,411,100 A 5/1995 Laskaris et al.
5,427,181 A 6/1995 Laskaris et al.
5,765,644 A 6/1998 Arvidson et al.
5,868,550 A 2/1999 Howchin
5,979,564 A 11/1999 Crabtree
6,085,586 A 7/2000 Arvidson et al.
6,155,351 A 12/2000 Breedlove et al.
6,357,532 B1 3/2002 Laskaris et al.

(Continued)

FOREIGN PATENT DOCUMENTS

GB 1360478 A 7/1974

OTHER PUBLICATIONS

EP Search Report issued on Jul. 13, 2009 in EP Application No. 09157690.0.

*Primary Examiner* — Davis Hwu
(74) *Attorney, Agent, or Firm* — Panitch Schwarze Belisario & Nadel LLP

(57) ABSTRACT

A fire suppression system having a foam proportioning system, a water source, and a controller. The foam proportioning system includes a foam tank having at least two types of chemical foamants, a selector valve in fluid communication with the foam tank for selecting one of the at least two types of chemical foamants, a foam pump in fluid communication with the selector valve for supplying the selected chemical foamant to a discharge unit, and a foam controller operatively connected to the foam pump and the selector valve. The water source is connected to the foam proportioning system for mixing water with the selected chemical foamant to form a fire suppression fluid. The controller is operatively connected to the foam proportioning system and includes a one-touch activation control for activating the controller. The controller is also configured to automatically output to the foam controller inputs for configuring the foam pump.

4 Claims, 17 Drawing Sheets

(56) References Cited

U.S. PATENT DOCUMENTS

| | | | | |
|---|---|---|---|---|
| 6,406,618 | B1 | 6/2002 | O'Leary | |
| 6,766,863 | B2 | 7/2004 | Arvidson et al. | |
| 6,991,041 | B2 | 1/2006 | Laskaris et al. | |
| 7,107,129 | B2 * | 9/2006 | Rowe et al. | 701/1 |
| 7,274,976 | B2 * | 9/2007 | Rowe et al. | 701/1 |
| 7,451,028 | B2 * | 11/2008 | Pillar et al. | 701/50 |
| 7,836,964 | B2 * | 11/2010 | Groonwald et al. | 169/24 |
| 2005/0077057 | A1 | 4/2005 | Laskaris | |
| 2005/0222287 | A1 | 10/2005 | Roberts | |
| 2008/0292472 | A1 | 11/2008 | Laskaris | |

* cited by examiner

| Description | Pressure | Foam Type % |
|---|---|---|
| Trash/Brush Fire | 100 psi | A-0.3 |
| Structure Fire | 150 psi | A-0.5 |
| Exposure Protection | 90 psi | A-1.0 |
| Automobile Fire | 110 psi | B-3.0 |
| Liquid Hydrocarbon Fire | 125 psi | B-1.0 |
| Polar Solvent Fire | 125 psi | B-3.0 |

INTEGRATED CONTROLS FOR A FIRE SUPRESSION SYSTEM

CROSS-REFERENCE TO RELATED APPLICATIONS

The present application is a divisional of U.S. patent application Ser. No. 12/421,132, filed Apr. 9, 2009 and entitled "Integrated Controls For A Fire Suppression System," which claims priority to U.S. Provisional Patent Application No. 61/043,436, filed Apr. 9, 2008 and entitled "Integrated Controls for a Fire-Fighting System"

BACKGROUND OF THE INVENTION

This invention generally relates to improving fire suppression systems and techniques and, more particularly, to integrated controls for a fire truck water pump and/or a drive transmission for a fire truck to reduce the occurrence of human error and to improve the efficiency of extinguishing fires.

Fortunately, over the past 20-30 years, the total number of structural fires per year has declined. However, the total number of firefighter deaths and the amount of money lost as a result of fires has not experienced the same decline. In fact, approximately the same number of firefighters die per 100,000 structural fires currently as in years past. As there may be many reasons for this increase in firefighter casualties, one cited problem is a lack of real world experience for firefighters due to fewer occurrences of fires. While increasing the frequency of training is, of course, part of the solution, additional training alone will probably not solve all of these problems. Training inexperienced firefighters on emergency procedures and operations does not truly mimic the urgent, often confused and conflicting information present at an evolving emergency scene.

At a typical fire, quick and efficient pump and foam system operations are a necessity and are not something to be left to chance, particularly in view of the real possibility of human error. Unfortunately, human error is most likely to occur when time is most critical, that is when the fire truck first arrives at the scene of the fire and the pump must be set up. Another factor in the effectiveness of fire suppression is that the size of fire-fighting crews has been noticeably downsized in recent years, due in part to economic conditions. In some areas, fire-fighting crews that previously included 4, 5 or 6 firefighters have been reduced to only 2 or 3 individuals in recent years. Due to such manpower decreases, each firefighter must be as effective and as efficient as possible. It is often the case that the initial actions of the fire-fighting crew on the scene of a fire can determine the entire success or failure of the operation. Therefore, removing non-value added tasks and the associated opportunities for defect or error can be a real improvement in the effectiveness of firefighters.

In conventional plumbing assemblies for fire trucks or other fire suppression systems, water supplied from a water source, such as a fire hydrant fills a supply hose and is forced to the truck. Air that is initially enclosed within the empty supply hose is pushed ahead of the water and up to a master intake valve. If the master intake valve is opened without "bleeding", or removing the air in front of the water, the pump momentarily becomes "air-bound" and the engine controller speeds up. Once the air is pushed past the impeller of the pump, the pressurized water from the hydrant hits the impeller at elevated engine speeds and a dangerous pressure spike can occur.

Further, conventional fire trucks or other fire suppression systems include a fire pump panel that allows a firefighter to select the exact system parameters for which to fight the fire, such as pump speed and pressure, foam type and foam-to-water ratio. In operation, the firefighter is required to independently select the pump pressure or speed, then independently select the foam type, turn the foam on to release the foam into the water flow, and finally select the desired foam percentage in relation to the water flow. As is well known by those skilled in the art, this process can be relatively time consuming in an emergency and may prevent the firefighter from focusing on more critical needs. Also, this multiple selection process provides an opportunity for human error in selecting the wrong operating settings, especially if the firefighter is relatively inexperienced and is facing high stress due to the emergency situation.

In addition, the typical fire truck pump engagement sequence is an area that can cause problems for a firefighter in an emergency. Traditionally, the pump of a fire truck or other fire suppression system is driven by a power take-off from the truck engine. Engagement of the pump typically requires that the firefighter shift the fire truck transmission to "neutral", then engage the pump transmission, verify that the shift has been properly completed, and finally place the transmission back into "drive." Further, once the fire has been extinguished and it is time to leave the scene, the firefighter must place the truck transmission into "neutral", allow the driveshaft to stop rotating, then shift the pump transmission out of "drive" so that the truck can be driven again. If the firefighter does not properly complete either of these sequences in the correct order, the gears of the fire truck could clash and grind. Obviously, grinding damages the transmission and potentially renders the fire truck inoperable. Additionally, this process may waste valuable time in an emergency.

Therefore, it would be desirable to create an automated tank-to-hydrant change-over process to ensure correct control of the incoming water supply to the fire suppression system or fire truck. Specifically, it would be desirable to allow the firefighter to automatically bleed or remove the air in front of the water inside the supply hose with the push of a single button, such that a pressure spike at the impeller is avoided. Further, it would be desirable to provide a firefighter with the opportunity to chose from at least two predetermined established conditions of flow and pressure for the water and foam to meet the specific requirements of each fire. Furthermore, it would be desirable to provide an interlock that provides a one-touch activated shift sequence. Specifically, it would be desirable to provide an interlock that automatically ensures that the parking brake is on and that the truck transmission is in "neutral" before making the pump shift and returning the fire truck transmission to "drive."

BRIEF SUMMARY OF THE INVENTION

Briefly stated, the present invention is directed to a fire suppression system comprising a plumbing assembly, an engine, a hose, an air-bleed valve, and a controller. The plumbing assembly includes a water tank, a pump having an input and an output in fluid communication with the water tank, a master intake valve in fluid communication with the input of the pump, and a one-way check valve in fluid communication with the water tank, the pump, and the master intake valve. The one-way check valve is located between the water tank and both the pump and the master intake valve. The engine drives the pump. The hose includes a second end, and a first end for connecting to a water supply. The air-bleed valve is in fluid communication with the hose and the master intake valve and positioned between the second end of the hose and the master intake valve. The air-bleed valve includes a level sensor for detecting the presence of air within the hose. The controller is operatively connected to the air-bleed valve, the engine, and the pump. The controller includes a one-touch activation control to activate the controller. The controller is configured to activate the air-bleed valve to remove air from the hose and to prevent increases in pump pressure by the pump by preventing the engine from increasing engine speed when the controller receives a signal from the air-bleed valve indicating the presence of air within the hose.

In another aspect, the present invention is related to a method of bleeding air from a hose for a fire suppression system. The fire suppression system includes a plumbing assembly and an engine. The plumbing assembly includes a water tank, a tank-to-pump valve in fluid communication with the water tank, a pump in fluid communication with the tank-to-pump valve and the water tank, a master intake valve in fluid communication with the pump, and an air-bleed valve in fluid communication with the master intake valve. The air-bleed valve includes a level sensor. A hose is connected to and in fluid communication with the air-bleed valve and a water supply. The engine drives the pump. The method includes the steps of providing a controller that includes a one-touch activation control to activate the controller, wherein the controller is operatively connected to the air-bleed valve, the engine, and the master intake valve; actuating the one-touch activation control to activate the controller; sensing the presence of air within the hose by the level sensor; signaling the controller of the presence of air sensed within the hose by the level sensor; outputting a command signal from the controller to open the air-bleed valve to bleed air upon receiving the signal sensing the presence of air within the hose; and outputting a command signal from the controller to the engine to halt increases in engine speed to prevent increases in pump pressure upon receiving the signal sensing the presence of air within the hose.

In yet another aspect, the present invention is directed to a fire suppression system comprising a foam proportioning system, a water source, and a controller. The foam proportioning system includes a foam tank having at least two types of chemical foamants, a selector valve in fluid communication with the foam tank for selecting one of the at least two types of chemical foamants, a foam pump in fluid communication with the selector valve for supplying the selected chemical foamant to a discharge unit, and a foam controller operatively connected to the foam pump and the selector valve. The water source is connected to the foam proportioning system for mixing water with the selected chemical foamant to form a fire suppression fluid. The controller is operatively connected to the foam proportioning system and includes a one-touch activation control for activating the controller. The controller is also configured to automatically output to the foam controller inputs for configuring the foam pump and the selector valve to establish a predetermined fire suppression fluid composition.

In a further aspect, the present invention is directed to a method of proportioning foam. The method comprises the steps of providing a foam proportioning system; providing a foam controller operatively connected to the foam proportioning system; providing a controller that includes a one-touch activation control to activate the controller and to input a predetermined fire suppression fluid composition, wherein the controller is operatively connected to the foam controller; actuating the one-touch activation control to activate the controller; and outputting a command signal from the controller to the foam controller for configuring the foam controller to configure the foam proportioning system to output a fire suppression fluid having the predetermined fire suppression fluid composition.

In another aspect, the present invention is directed to an integrated control system for a fire truck comprising an interlock controller and a one-touch activation control. The fire truck includes a pump having at least one pump mode for pumping a fire suppression fluid, a parking brake and a parking brake sensor for sensing engagement of the parking brake, an engine for driving the fire truck, a transmission and a transmission sensor for sensing engagement of the transmission, and a power take off system for diverting engine power from a drive axle of the fire truck to the pump. The interlock controller is operatively connected to the pump, the parking brake sensor, the transmission sensor and the power take off system. The one-touch activation control is operatively connected to the interlock controller for activating the interlock controller. Upon actuation of the one-touch activation control, the interlock controller is configured to (a) receive an input signal of a selected pump mode from the pump, (b) receive an input signal from the parking brake sensor indicating if the parking brake is engaged when the input signal of the selected pump mode is received, (c) receive an input signal from the transmission sensor indicating if the transmission is in neutral, and (d) output a command signal to activate the power take off system so as to shift engine power from the transmission to the pump to enable operation of the selected pump mode only when the parking brake is engaged and the transmission is in neutral.

In a further aspect, the present invention is directed to an integrated control system for a fire truck comprising a one-touch activation control and an interlock controller. The fire truck includes a tank sensor for sensing the contents of a tank within the fire truck, an engine having at least a low gear and a high gear for driving the fire truck and an engine sensor, a torque converter operatively connected to the engine, a transmission sensor for sensing engagement of a transmission operatively connected to the torque converter, a drive shaft sensor for sensing rotation of a drive shaft operatively connected to the transmission, a pump having at least one pump mode for pumping a fire suppression fluid, and a pump sensor for sensing operation of the pump, a plumbing assembly operatively connected to the pump and the tank, the plumbing assembly including a tank-to-pump valve and a tank fill valve, a foam system connected to the plumbing assembly, a parking brake sensor for sensing engagement of a parking brake, a power take off sensor for sensing engagement of a power take off system that diverts engine power from the transmission to the pump, an alert display for communicating one or more alerts, a dry pump timer for timing an operation of the pump, a primer for priming the pump, a motion sensor for sensing motion of the fire truck, a control panel for receiving inputs from a user, and a foam controller for controlling the foam system. The interlock controller is operatively connected to the one-touch activation control, the alert display, the dry pump timer, the engine, the parking brake sensor, the transmission sensor, the torque converter, the drive shaft sensor, the power take off sensor, the primer, the pump, the tank sensor, the tank fill valve, the motion sensor, the pump sensor, the control panel and the foam controller. Upon actuation of the one-touch activation control on selecting a pump mode, the interlock controller is configured to (a) receive an input signal of the selected pump mode from the pump, (b) receive an input signal from the motion sensor indicating if the fire truck is in motion when the input signal of the selected pump mode is received, (c) output an alert signal to the alert display if the fire truck is determined to be in motion, (d) receive an input signal from the parking brake sensor indicating if the parking brake is engaged when the fire truck is not in motion, (e) output an alert signal to the alert display if the parking brake is determined to be disengaged, (f) receive an input signal from the transmission sensor indicating if the transmission is in neutral when the parking brake is determined to be engaged, (g) output a command signal to the transmission to shift the transmission into neutral when the transmission is determined to not be in neutral, (h) output a command signal to the power take off system to activate the power take off system to shift engine power from the transmission to the pump so as to enable operation of the selected pump mode when the transmission is determined to be in neutral, (i) receive an input signal from the power take off sensor to verify that the power take off system has shifted engine power to the pump and then output a command signal to the engine to increase engine speed, (j) output a command signal to the transmission to drive the engine in the low gear, (k) receive an input signal from the drive shaft sensor indicating if the drive shaft of the transmission is rotating after the command signal to drive the engine in the low gear has been outputted, (l) output an alert signal to the alert display and a command signal to the transmission to shift the transmission to neutral when the drive shaft is determined to be stationary, and (m) output a command signal to the engine to drive the engine in the high gear when the drive shaft is determined to be rotating and output a command signal to the torque converter to lock the torque converter in gear.

In yet another aspect, the present invention is directed to a method of operating an interlock and pump shift for a fire truck. The fire truck includes a tank for holding a fire suppression fluid, a pump having at least one pump mode for pumping the fire suppression fluid, a plumbing assembly operatively connected to the pump, the tank, and the fire truck, the plumbing assembly having a tank-to-pump valve and a tank fill valve, a foam system connected to the plumbing assembly, a parking brake for maintaining the fire truck in park, an engine having a low gear and a high gear for driving the fire truck, a torque converter operatively connected to the engine, a transmission operatively connected to the torque converter, a drive shaft operatively connected to the transmission, a power take off system operatively connected to the transmission for diverting engine power from a drive axle of the fire truck to the pump, and an alert display for communicating one or more alerts. The method includes the steps of receiving an input of a selected pump mode; determining if the fire truck is moving when the input is received; outputting an alert signal to the alert display when the fire truck is moving; determining if the parking brake is engaged when the fire truck is determined to be stationary; outputting an alert signal to the alert display when the parking brake is disengaged; determining if the transmission is in neutral when the parking brake is engaged; shifting the transmission into neutral when the parking brake is disengaged if the transmission is not in neutral; shifting engine power from the fire truck to the pump when the transmission is in neutral so as to enable operation of the selected pump mode; verifying that the shift of engine power has been completed; increasing engine speed when the shift of engine power has been verified; driving the engine in the low gear after increasing engine speed; sensing the drive shaft to determine if rotation of the drive shaft has begun; shifting the transmission to the neutral position when the drive shaft is stationary if the transmission is not in neutral; and driving the engine in the high gear when the drive shaft has been sensed to be rotating.

BRIEF DESCRIPTION OF THE SEVERAL VIEWS OF THE DRAWINGS

The following detailed description of preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
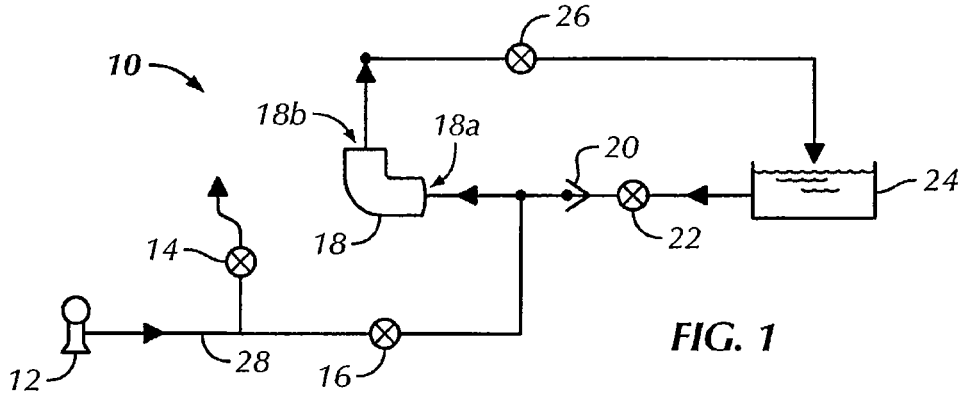
FIG. 1 is a schematic block diagram of a plumbing assembly for a fire suppression system in accordance with a preferred embodiment of the present invention.

Certain terminology is used in the following description for convenience only, and is not limiting. The words "right," "left," "upper," and "lower" designate directions in the drawings to which reference is made. The words "inwardly" and "outwardly" refer to directions toward and away from, respectively, the geometric center of the system and designated parts thereof. The terminology includes the words above specifically mentioned, derivatives thereof, and words of similar import.

Figure 3:
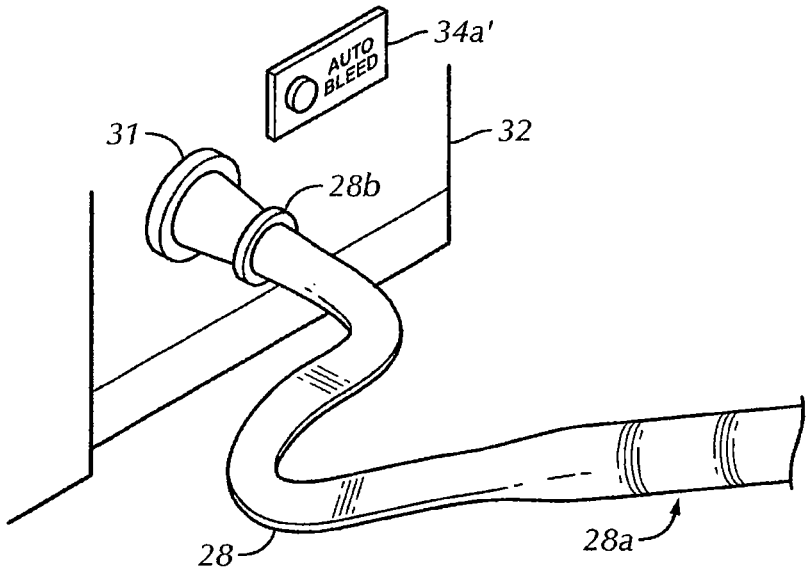
FIG. 3 is a perspective view of a water supply hose, in a partially filled state, that is connected to an exterior of the fire suppression system shown in FIG. 2.
Figure 2:
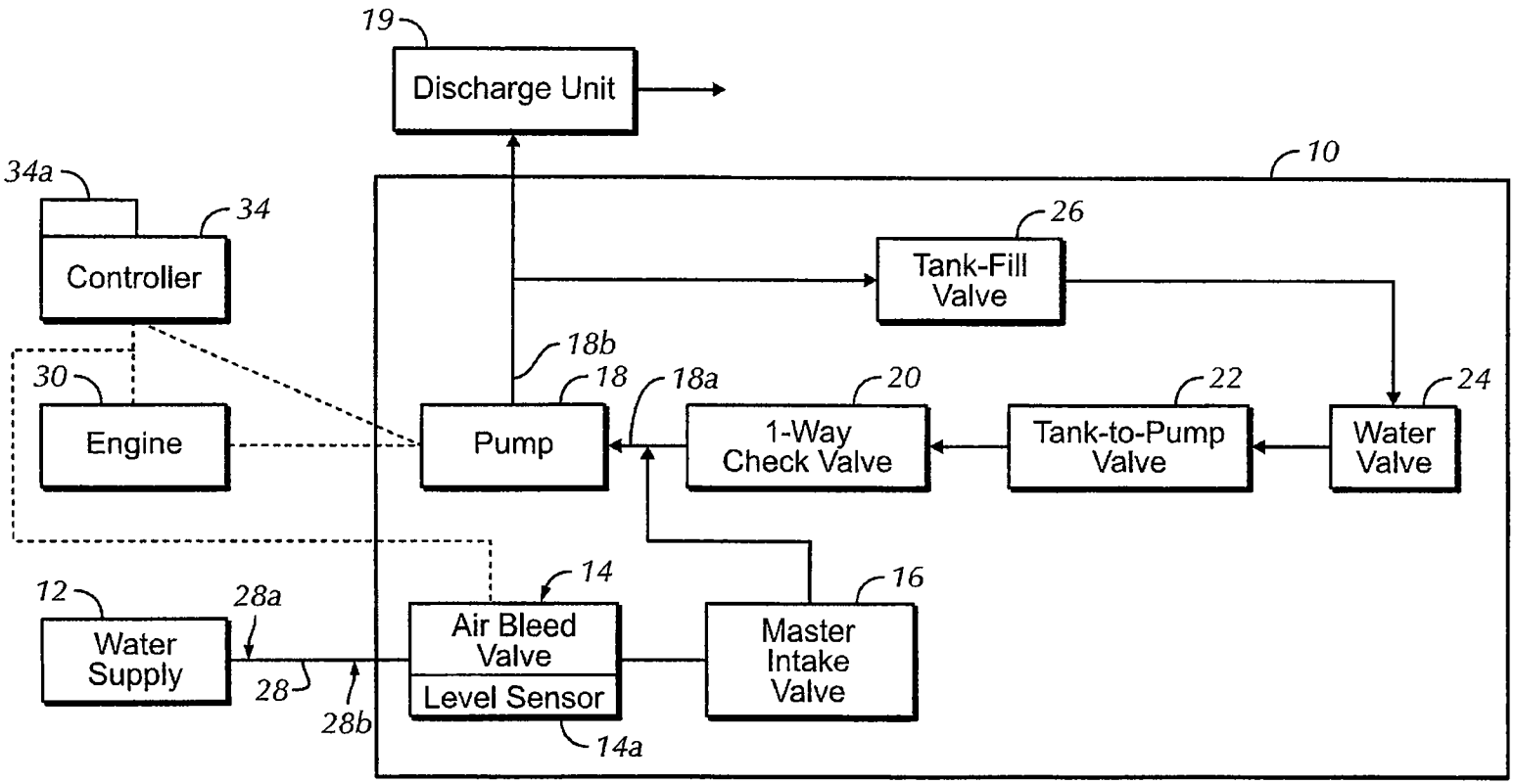
FIG. 2 is a schematic block diagram of a fire suppression system that includes the plumbing assembly of FIG. 1.

Referring to the drawings in detail, wherein like numerals indicate like elements throughout, there is shown in FIGS. 1-3 a preferred embodiment of a fire suppression system capable of automating a tank-to-hydrant change-over process. The fire suppression system ensures correct control of a flow of a fire suppression fluid, such as water from an incoming water supply, into the fire suppression system, such as a conventional fire truck. The fire suppression system for automating the tank-to-hydrant change-over process advantageously eliminates dangerous pressure surges during the change-over operations that may occur with conventional manual change-overs.

Referring to FIGS. 1 and 2, there is shown schematic diagrams of a plumbing assembly, generally designated 10, of the fire suppression system. The plumbing assembly 10 includes a water tank 24, a pump 18, a master intake valve 16 and a one-way check valve 20. In general, the plumbing assembly 10 is capable of being connected to a positive water pressure supply 12, such as a conventional fire hydrant, to supply water to the plumbing assembly 10, which in turn is used to extinguish or suppress a fire. Specifically, the water pressure supply 12 is connected to the master intake valve 16 within the plumbing assembly 10 via a conventional water supply hose 28 (see also FIG. 3). Within the plumbing assembly 10, an air-bleed valve 14 is operatively connected to the water supply hose 28 to allow a user, such as a firefighter, to release air trapped within the water supply hose 28. Such air-bleed valves 14 are well known in the art and a detailed description of them is not necessary for a complete understanding of the present invention. However, such air-bleed valves 14 applicable to the present invention include, for example the 4000 series by Gems Sensors and Controls of Plainville, Conn.

The pump 18 is in fluid communication with the water tank 24 and includes an input 18*a* and an output 18*b*. The pump outlet 18*b* is in fluid communication with a discharge unit 19 and a tank fill valve 26. The one-way check valve 20 is in fluid communication with the water tank 24, the pump 18 and the master intake valve 16, which is in fluid communication with the input 18*a* of the pump 18. In addition, the one-way check valve 20 is located between the water tank 24 and both the pump 18 and the master intake valve 16. As water passes through the master intake valve 16, the water may be drawn solely toward the pump 18 since the check valve 20 prevents water flow towards the tank 24.

Preferably, the plumbing assembly 18 includes a tank-to-pump valve 22 located between and in fluid communication with the check valve 20 and the water tank 24. The tank-to-pump valve 22 controls the flow of water out of the water tank 24 to the pump 18.

A tank fill valve 26 is located downstream pump 18, but before the connection to the water tank 24. The tank fill valve 26 is in fluid communication with the output 18*b* of the pump 18 and water tank 24 to control the flow of water from the pump 18 to the water tank 24 for filling the tank 24. The interaction between the pump 18, check valve 20, tank-to-pump valve 22, water tank 24 and tank fill valve 26 is understood by those skilled in the art and will not be described in further detail herein. Further, it is understood by those skilled in the art that the plumbing assembly 10 is not limited to the inclusion of each component described above, but may be modified to include additional or fewer components without departing from the spirit and scope of the present invention.

Referring to FIGS. 2 and 3, in operation, a firefighter or other user connects a first end 28*a* of the water supply hose 28 to the water supply 12 (e.g., a fire hydrant) and a second end 28*b* of the water supply hose 28 to the plumbing assembly 10. The plumbing assembly 10 can be located within a fire truck 32, as shown in FIG. 3. However, it is understood by those skilled in the art that the plumbing assembly 10 can be located outside of the fire truck 32 or even completely separate from the fire truck 32.

The fire suppression system 10 also includes an engine 30 and a controller 34. The engine 30 is operatively connected to the pump 18 for driving or powering the pump 18, as well as for powering the fire truck 32, if so configured.

The air-bleed valve 14 includes a level sensor 14*a*. Such air-bleed valves 14 and level sensors 14*a* are well known in the art and a detailed description them is not necessary for a complete understanding of the present invention. The air-bleed valve 14 is configured to be in fluid communication with the second end 28*b* of the hose 28 and the master intake valve 16. In operation, the level sensor 14*a* allows the air-bleed valve 14 to detect the presence of air with the hose 28.

Figure 4:
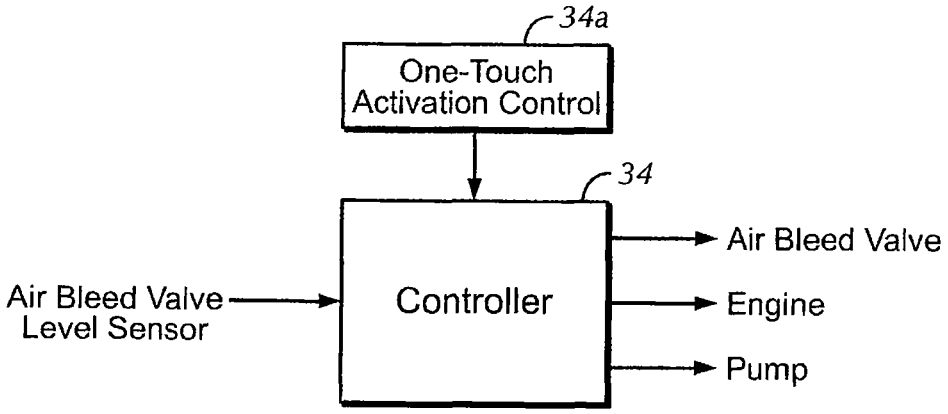
FIG. 4 is a schematic block diagram of a controller in accordance with the fire suppression system of FIG. 2.

The controller 34 can be any conventional controller, such as a computer or logic control system (e.g., a total pressure governor by Hale Products, Inc., of Conshohocken, Pa., a SAE J1939 vehicle bus, or a controller area network) and is schematically shown in FIG. 4. The controller 34 is operatively connected to at least the engine 30, pump 18, and air-bleed valve 14. The controller 34 also includes a one-touch activation control 34*a* for activating the controller 34. That is, the one-touch activation control 34*a* is configured to be activated by a single point contact or single action, without the need for multiple actions, steps or adjustments. The controller 34 is configured to activate the air-bleed valve 14 so as to remove air from the hose 28 and to prevent increases in pump pressure by the pump 18. Increases in pump pressure are prevented by the controller 34 which prevents the engine 30 from increasing engine speed when the controller 34 receives a signal from the air-bleed valve 14 indicating the presence of air within the hose 28. As such, the one-touch activation control 34*a* can advantageously prevent dangerous pressure spikes from occurring by not only removing air from within the hose 28, but by also preventing the engine 30 from increasing engine speed. This offers a significant advantage over conventional systems which increase engine speed in the presence of air within the hose 28 to compensate for the associated pressure drop. Such increases in engine speed associated with air within the hose 28 can result in dangerous pressure spikes and potential harm to both the system and users. In addition, the one-touch activation control 34*a* provides for a much simplified operational procedure for a user.

The one-touch activation control 34*a* can be configured as a one-touch air release mechanism 34*a*' (FIG. 3) proximate to a fitting 31 to which the water supply hose 28 is secured. Specifically, the activation control 34*a* can be in the form of an auto-bleed button 34*a*' mounted to an exterior surface of the fire truck 32. The auto-bleed button 34*a*', which is operatively connected to the controller 34 (FIG. 2) of the plumbing assembly 10, is conveniently located such that it is in plain view to a firefighter and can be easily and quickly accessed during an emergency. The auto-bleed button 34*a*' allows the firefighter to selectively and conveniently activate the controller 34 to activate the air-bleed valve 14 to release excess or unwanted air from within the water supply hose 28 at or near the time that the water supply hose 28 is secured to the fitting 31.

As shown in FIG. 3, when the water supply hose 28 is not in use, it is typically in a partially air-filled state. For example, the water supply hose 28 is usually found in a partially air-filled state prior to opening a valve (not shown) within the water supply 12 to allow water to flow toward the fire truck 32. A distal end (i.e., toward the second end 28*b*) of the supply hose 28 is shown in a generally flat state in which only air is located within the hose 28. Immediately after the water supply 12 is turned on, a proximate end (i.e. toward the first end 28*a*) of the hose 28 is expanded from the flattened state as it is filled with water rushing toward the distal end of the hose 28.

To employ the air release mechanism 34*a*', the firefighter connects the water supply 12 to the fire truck 32 via the water supply hose 28 and fitting 31, as is well known in the art. Next, in one particular arrangement, the firefighter may open the valve within the fire hydrant 12 to release the stored water through the water supply hose 28 and to the plumbing assembly 10 of the fire truck 32. Next, the firefighter depresses the auto-bleed button 34*a*'. Such one-touch operation of the auto-bleed button 34*a*' causes the controller 34 to activate the air-bleed valve 14 to automatically bleed or remove the air in front of the water inside the water supply hose 28 (FIGS. 1 and 2).

In addition, the one-touch operation of the auto-bleed button 34*a*' causes the controller 34 to prevent increases in pump pressure by the pump 18 upon the auto-bleed valve 14 detecting the presence of air within the hose 28. Further increases in pump pressure by the pump 18 is prevented upon actuation auto-bleed button 34*a*' by the controller 34, which is configured to prevent increases in engine speed. Preventing the engine speed from increasing, indirectly prevents the pump 18 from increasing pump pressure.

The controller 34 can alternatively be further configured to open the master intake valve 16, close the tank-to-pump valve 22, and fill the water tank 24 upon actuation of the auto-bleed button 34*a*' or when the air-bleed valve 14 detects the presence of air within the hose. As a result, pressure spikes at the impeller of pump 18 can be avoided in the plumbing assembly 10 by activation of the auto-bleed button 34*a*'.

In general, when air-bleed valve 14 opens to bleed air within the hose 28 when the level sensor 14 of the air-bleed valve 14 senses the presence of air within the hose. The air-bleed valve 14 not only senses the presence of air within the hose at time of actuation of the one-touch activation control 34*a*, but also continuously senses for the presence of air within the hose 28 once the one-touch activation control 34*a* has been actuated. It is understood by those skilled in the art that the operation of the air-bleed valve 14 is not limited to the order of operations described above. For example, the air-bleed valve 14 can automatically be activated or turned on once the pump 18 is engaged or the fire suppression system is in gear, or manually adjusted by the firefighter to allow the firefighter to override the operation at a later time.

The fire suppression system of the present embodiment advantageously allows not only for the simplified operation of bleeding air from within a hose 28, but does so in a much safer and reliable manner. That is, not only is air bleed from the hose 28, but the fire suppression system also prevents increases in pump pressure when air is detected within in the hose 28.

Figure 5:
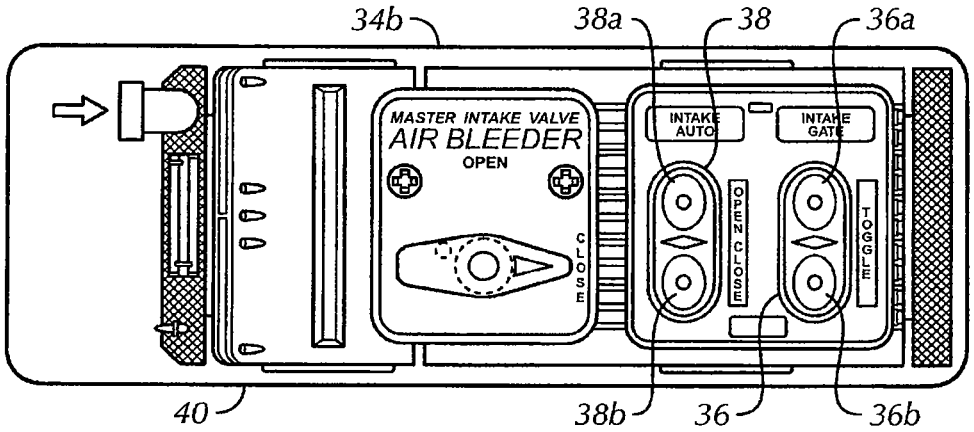
FIG. 5 is a computer graphic of a control panel for a master intake valve in accordance with the fire suppression system of FIG. 2.

FIG. 5 illustrates an air-bleed control panel 34*b* operatively connected to the controller 34. The control panel 34*b* can be located on an exterior surface of the fire truck 32. It is understood by those skilled in the art that the air-bleed control panel 34*b* may entirely replace the one-touch activation control 34*a* as described above or be in addition to the one-touch activation control 34*a* to provide firefighters with more control in operating the fire suppression system.

Specifically, the control panel 34*b* can include an air-bleed valve toggle knob 36 and an air-bleed valve auto knob 38. The air-bleed valve toggle knob 36 is configured to operatively control the air-bleed valve 14 so as to enable a user to selectively open and close the air-bleed valve 14 to varying degrees. For example, the air-bleed control panel 34*b* includes toggle buttons 36*a*, 36*b* and open and close buttons 38*a*, 38*b*. The air-bleed valve auto knob 38 is configured to operatively control the air-bleed valve 14 in either an open or a closed position.

As seen in FIG. 5, the various buttons or controls of the air-bleed control panel 34*b* are located within an aesthetically pleasing depiction of a top plan view of a conventional fire truck 40. However, it is understood by those skilled in the art that the fire truck 40 shown on the control panel 34*b* is for aesthetic purposes only. Those skilled in the art would understand that the depiction may be modified without departing from the broad inventive concept thereof. For example, the buttons and controls of the control panel 34*b* may be arranged in any configuration or may be of any size without departing from the spirit and scope of the present invention.

Figure 6:
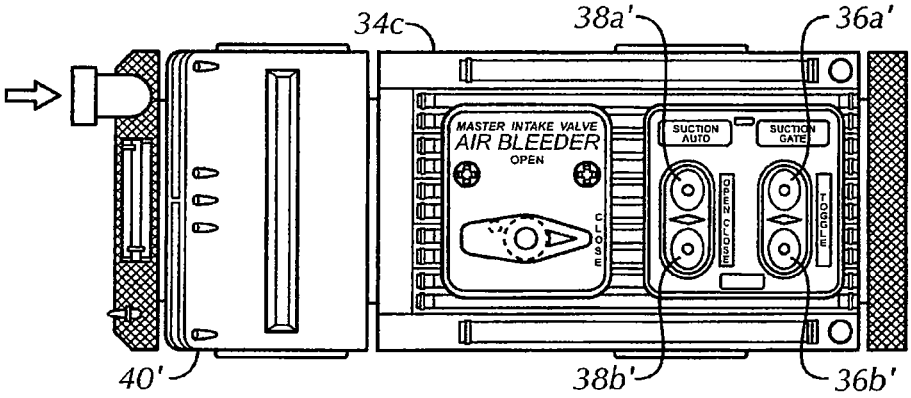
FIG. 6 is a computer graphic of another embodiment of the control panel for a master intake valve of the fire suppression system of FIG. 2.

Referring to FIG. 6, there is shown another embodiment of the air-bleed control panel 34*c*, which includes like referenced numerals to indicate like elements. The air-bleed control panel 34*c* is substantially similar in structure and operation to air-bleed control panel 34*b* described above. However, the air-bleed control panel 34*c* differs from that of air-bleed control panel 34*b* in certain symbols on the depiction of the fire truck 40' and the names of certain buttons and controls. For example, the air-bleed control panel 34*c* includes toggle buttons 36*a*', 36*b*' and open and close buttons 38*a*', 38*b*'. It is understood by those skilled in the art that the control panels 34*b*, 34*c* are not limited to the specific controls and buttons described above and shown herein, but may be modified to include additional or fewer controls and buttons without departing from the spirit and scope of the present invention.

Figure 7:
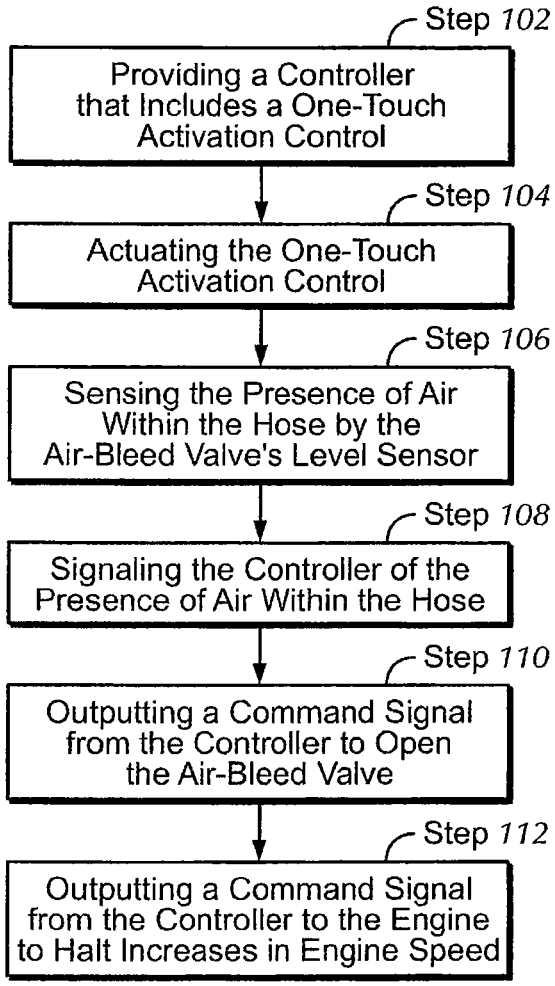
FIG. 7 is a flow chart of a method of bleeding a hose for a fire suppression system in accordance with another preferred embodiment of the present invention.

The present invention also provides for a method of bleeding air from a hose of the fire suppression system described above. In particular, the method includes the steps as illustrated in the flowchart of FIG. 7. That is, the controller 34, including the one-touch activation control 34*a* for activating the controller 34, is provided (Step 102). The controller 34 is operatively connected to the air-bleed valve 14, the engine 30, and the master intake valve 16. The one-touch activation control 34*a* is then actuated to active the controller 34 (Step 104). The level sensor 14*a* then senses for the presence of air within the hose 28 (Step 106). Upon detecting the presence of air within the hose 28 by the level sensor 14*a*, the level sensor 14*a* signals the controller 34 regarding the detected air (Step 108). The controller 34 upon receiving the signal from the level sensor 14*a* sensing the presence of air outputs a command signal to the air-bleed valve 14 to open, thereby bleeding the air within the hose 28 (Step 110). The controller 34 also outputs a command signal to the engine 30 to halt increases in engine speed to prevent increases in pump pressure upon receiving the signal sensing the presence of air within the hose 28 (Step 112). This method can further include the step of outputting a command signal from the controller 34 to open the master intake valve 16, close the tank-to-pump valve 22, and fill the water tank 24 upon receiving the signal sensing the presence of air within the hose 28 from the level sensor 14*a*.

Figure 8:
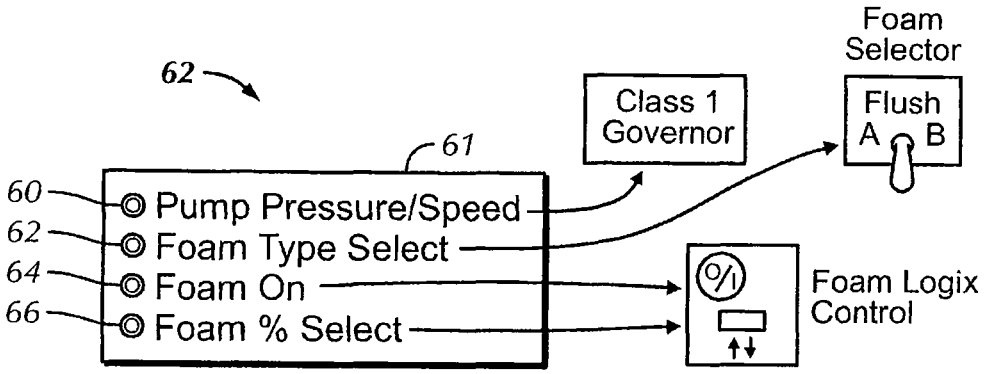
FIG. 8 (Prior Art)
FIG. 8 is a schematic block diagram of a conventional pump control panel for a prior art fire suppression system.

Referring to FIG. 8, a conventional pump control panel for fire suppression systems, generally designated 61 is shown. With such conventional pump controls the user or firefighter specifically select at least three separate parameters before beginning to extinguish the fire. For example, the conventional pump control panel 61 may include a pump pressure/speed selector 60, a separate foam type selector 62, a separate foam on/off switch 64, and a separate foam percentage selector 66. As discussed above, the process of choosing the appropriate parameters can be complicated and time consuming for firefighters during an emergency. In some instances, firefighters may completely forget to select a certain parameter, such as activating the foam on/off switch 64, resulting in a very inefficient and unproductive fire suppression technique. Alternatively, a user or operator may inadvertently select the wrong combination of water and foam flow, thus needlessly jeopardizing his or her own health and safety and the health and safety of others. Further, countless hours are invested each year into teaching firefighters to quickly and accurately select the appropriate parameters for a given fire. However, despite this investment, firefighters continue to erroneously select the proper settings.

Figure 9:
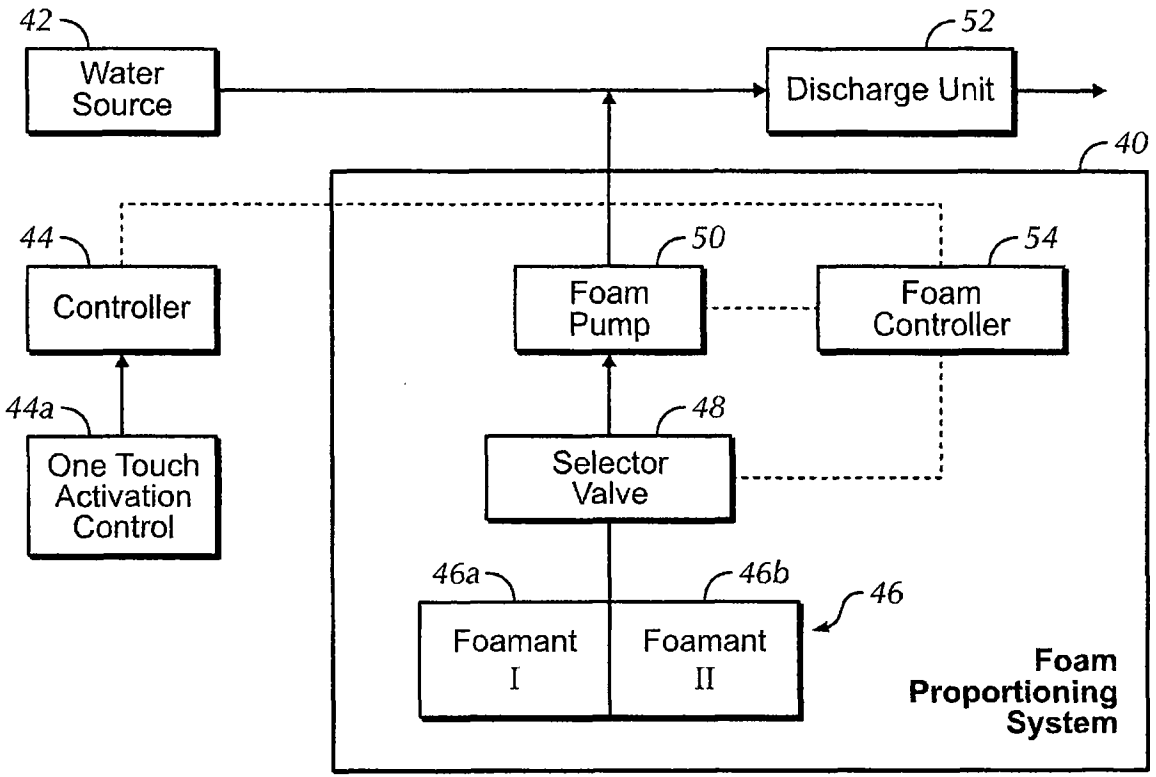
FIG. 9 is a schematic block diagram of a fire suppression system in accordance with yet another preferred embodiment of the present invention.

In view of these deficiencies with conventional pump controls, the present invention also provides for a fire suppression system that can be automatically configured to output a predetermined fire suppression fluid composition. The fire suppression system includes a foam proportioning system 40, a water source 42, and a controller 44, as shown in FIG. 9. The foam proportioning system 40 includes a foam tank 46, a selector valve 48, a foam pump 50, and a foam controller 54. The foam tank 46 includes at least two chemical foamants 46*a*, 46*b*. The selector valve 48 is in fluid communication with the foam tank 46 for selecting one of the at least two types of chemical foamants 46*a*, 46*b*. The foam pump 50 is connected to the selector valve 48 and a discharge unit 52 so as to be in fluid communication with each. In particular, the foam pump 50 receives an input from the selector valve 48 and pumps the selected foamant to the discharge unit 52. The foam controller 54 is operatively connected to the controller 44, the foam pump 50, and the selector valve 48.

The water source 42 is connected to the foam proportioning system 40 so as to be in fluid communication. The water from the water source 42 mixes with the selected chemical foamant that is being pumped out by the foam pump 50 for forming the fire suppression fluid.

Figure 10:
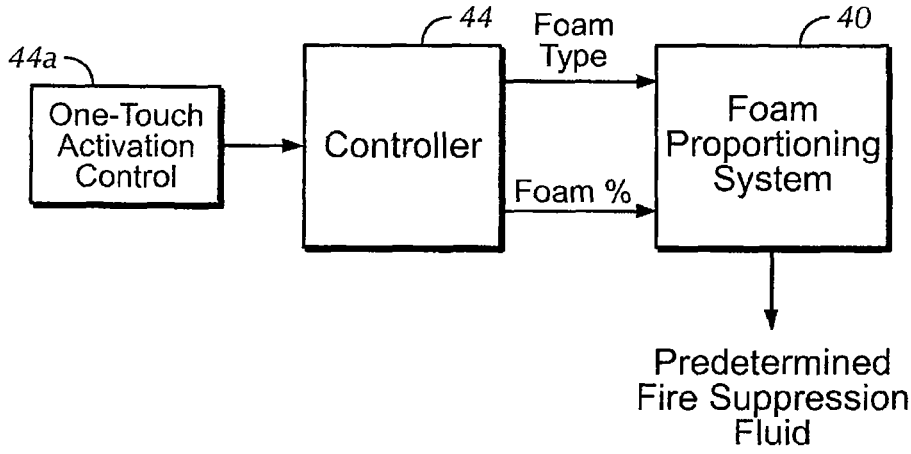
FIG. 10 is a schematic block diagram of a controller in accordance with the fire suppression system of FIG. 9.

The controller 44 is operatively connected to the foam proportioning system 40. Similar to the previous embodiment, the controller 44 includes a one-touch activation control 44*a* for activating the controller 44. In particular, the controller 44 is configured to automatically output to the foam controller 54 inputs for configuring the foam pump 50 and selector valve 48 to establish a predetermined fire suppression fluid composition. An overall schematic diagram of the function of the controller is shown in FIG. 10.

The predetermined fire suppression fluid composition is formed from a predetermined type of foamant selected from the foam tank 46. The various types of chemical foamants applicable to the present invention are well known in the art and a detailed description of such chemical foamants is not necessary for a complete understanding of the present invention. A predetermined concentration of the predetermined type of foamant also makes up the predetermined fire suppression fluid composition. In general, such predetermined fire suppression fluid compositions can be configured to suppress different types of fires. Such different types of fires include, for example, a trash or brush fire, a structural fire, a car fire, a flammable hydrocarbon liquid fire, a flammable polar solvent fire, and an exposure fire.

Figure 11:
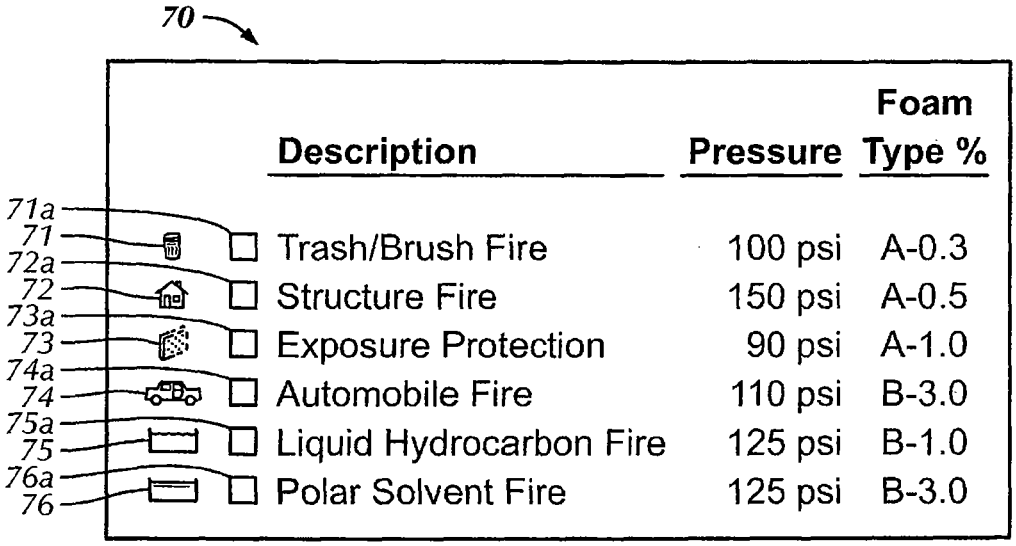
FIG. 11 is a schematic diagram of a pump control panel for the fire suppression system of FIG. 9.
Figure 12:
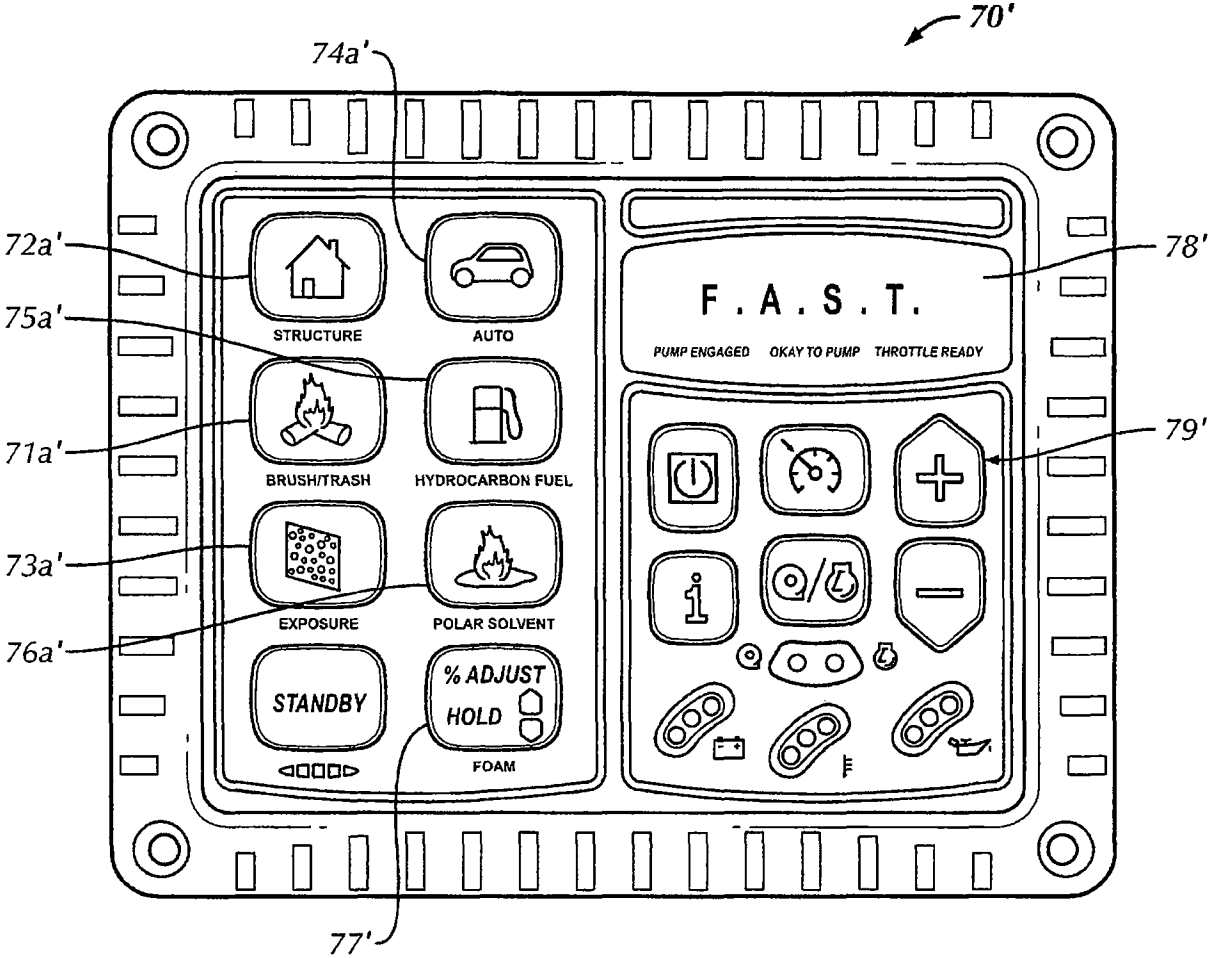
FIG. 12 is an elevational view of a first embodiment of a pump control panel for the fire suppression system of FIG. 9.
Figure 13:
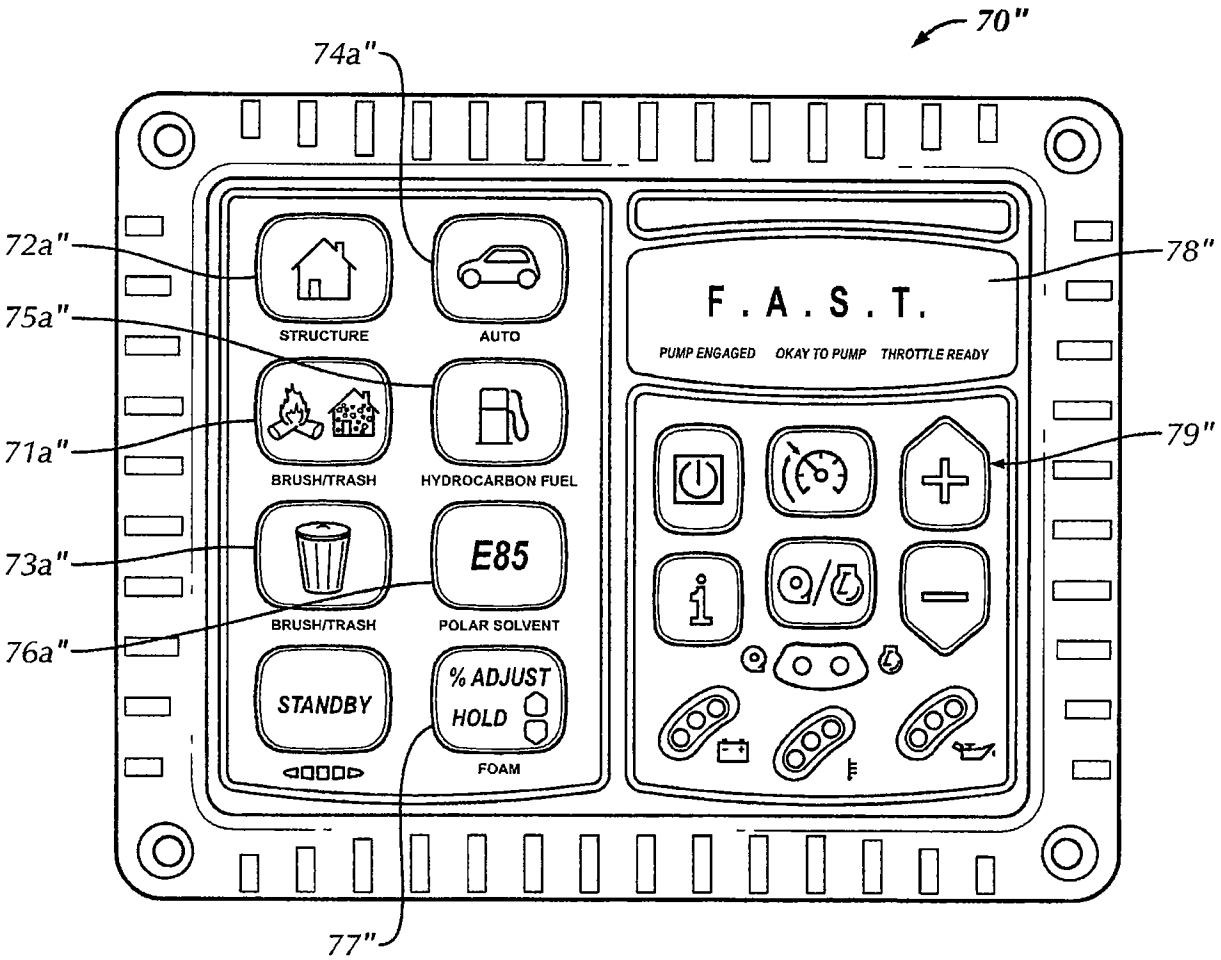
FIG. 13 is an elevational view of a second embodiment of a pump control panel for the fire suppression system of FIG. 9.

Referring now to FIGS. 11-13, there are shown first, second and third embodiments of a pump control panel, generally designated 70, 70', 70" respectively, applicable to the fire suppression system having the one-touch activation control 44*a*. The pump control panels 70, 70', 70" allow the user or firefighter to select any and/or all of the above-identified and other fire suppression parameters with the activation of a single one-touch activation button to meet the requirements of each fire. In addition, the second and third embodiments of the pump control panel 70', 70" of the present invention further provide firefighters with the capability to adjust the parameters depending on the type of fire. The pump control panels 70, 70', 70" are particularly beneficial because even if a firefighter fails to remember the proper operating pressure for the particular fire, he/she may simply press a single button to turn on the foam system and pump/engine to the appropriate rate and/or speed to deliver the required (i.e., pre-determined) fire suppression fluid composition at the appropriate flow rate.

The pump control panels 70, 70', 70" of the present invention include at least two, but preferably at least six one-touch activation controls 44*a* having icons or symbols to indicate the predetermined combinations of e.g., flow, pressure and foam concentration. Each icon includes a single button that may be depressed by the user or firefighter to activate the desired predetermined fire suppression fluid composition that is sufficient to suppresses a specific type of fire, such as a trash or brush fire, a structural fire, a car fire, a flammable hydrocarbon liquid fire, a flammable polar solvent fire, and an exposure fire. A brief written description section (FIG. 11) may be included proximate the icons and buttons to provide the firefighter with a more detailed account of the combination. Furthermore, predetermined pressure and foam type percentages for each combination may be listed to provide the firefighter with a more accurate account of the predetermined combinations of flow and pressure. It is understood by those skilled in the art that the icons and/or buttons of the pump control panels 70, 70', 70" are not limited to the specific function described herein, but may be modified to include additional or fewer icons and/or buttons for various types of fires. Further, it is understood by those skilled in the art that the control panels 70, 70', 70" are preferably mounted onto an exterior surface of the fire truck 32 to allow the firefighter to quickly and conveniently activate the desired combination. However, it is understood by those skilled in the art that the control panels 70, 70', 70" may be located virtually anywhere on or within the fire truck 32, such as inside the driver's cabin, without departing from the broad inventive concept thereof.

Specifically, referring to FIG. 11, the first embodiment of the pump control panel 70 includes a trash can icon (or symbol) 71 proximate a trash can button 71*a*. Upon activation of the trash can button 71*a*, the predetermined fire suppression fluid combination of pressure, foam type and foam percentage is automatically activated for effectively fighting a trash or brush fire. The pump control panel 70 also includes a structure fire icon 72 and button 72*a*, an exposure protection or exposure fire icon 73 and button 73*a*, an automobile or car fire icon 74 and button 74*a*, a flammable liquid hydrocarbon fire icon 75 and button 75*a*, and a flammable polar solvent fire icon 76 and button 76*a*. A specific description of the predetermined fire suppression fluid combination i.e., pressure, foam type and foam percentage, can be set forth next to the written description of each type of fire. The buttons of the pump control panel 70 that can form the one-touch activation controls 44*a*, can be any conventional spring biased push button or the like. However, it is understood by those skilled in the art that other buttons, switches or other selection devices may be used to construct the one-touch activation controls 44*a* without departing from the spirit and scope of the present invention. For example, touch sensors (not shown) may alternatively be employed. Further, the buttons may be replaced by a voice-recognition sensor (not shown) to allow the operator to select the desired combination without physically touching the pump control panel 70.

Referring to FIG. 12, the second embodiment of the pump control panel 70' is shown, including like referenced numerals to indicate like elements and (') distinguishing the reference numerals of the second embodiment from the first embodiment. The second embodiment of the pump control panel 70' is substantially similar in structure and operation to the first embodiment described above. The pump control panel 70' includes a plurality of push buttons on the left hand side of the control panel 70' that allow the operator to select a predetermined fire suppression fluid combination of e.g., flow, pressure, etc., at the touch of a single button. Each button includes an icon or symbol directly on the button depicting the application or type of fire for which the predetermined fire suppression fluid combination is designed to extinguish. It is understood by those skilled in the art that the user or firefighter can program the pump control panel 70' to automatically set the flow rates for certain circumstances. For example, the pump control panel 70' can be programmed for certain types of hoses and nozzles, the size or number of crew members for a particular firefighting crew or the target hazards in the area they protect.

The pump control panel 70' allows the firefighter to activate predetermined fire suppression fluid combinations for fires, such as a structural or house fire 72*a*', an automobile fire 74*a*', a brush/trash fire 71*a*', an explosion fire 73*a*', a hydrocarbon fuel fire 75*a*', and a polar solvent fire 76*a*'. Additionally, the control panel 70' can include a button 77' that allows the firefighter to adjust (increase or decrease) the foam percentage. This button 77' allows the firefighter to override any automatic combination previously activated. The pump control panel 70' may also include a light emitting diode (LED) screen 78' to provide the operator with instantaneous feedback as to the operation of the pump. Further, the pump control panel 70' may include a command panel 79' that includes a plurality of command buttons, such as a power button and an information button, and operation indicators, such as battery and oil levels.

Referring to FIG. 13, the third embodiment of the pump control panel 70" is shown, including like referenced numerals to indicate like elements and (") distinguishing the reference numerals of the third embodiment from the first and second embodiments. The third embodiment of the pump control panel 70" is substantially similar in structure and operation to the second embodiment described above. The pump control panel 70" includes a plurality of push buttons, such as a structural or house fire button 72*a*", an automobile fire button 74*a*", a brush/trash fire button 71*a*", an explosion fire button 73*a*", a hydrocarbon fuel fire button 75*a*", and a polar solvent fire button 76*a*" on the left hand side of the control panel 70" that allow the operator to select a predetermined fire suppression fluid combination of e.g., flow, pressure, etc., at the touch of a single button. The polar solvent button 76*a*", for example, allows a firefighter to select a foam mixture and pressure to effectively extinguish e.g., a polar solvent fire or an exposure fire. As is understood by those skilled in the art, a higher percentage of foam chemical and a lower flow rate is typically required to quickly extinguish an exposure fire. The polar solvent button 76*a*" preferably includes an "E85" icon thereon. Those skilled in the art understand that E85 is an ethanol based fuel. Activation of the polar solvent button 76*a*" selects a different foam tank on or in the fire truck for a specialized Class B foam and adjusts the foam percentage accordingly. Further, other buttons (e.g., 136) on the control panel 70" allow for manual control if the firefighter wants to modify settings for a special circumstance.

Figure 14:
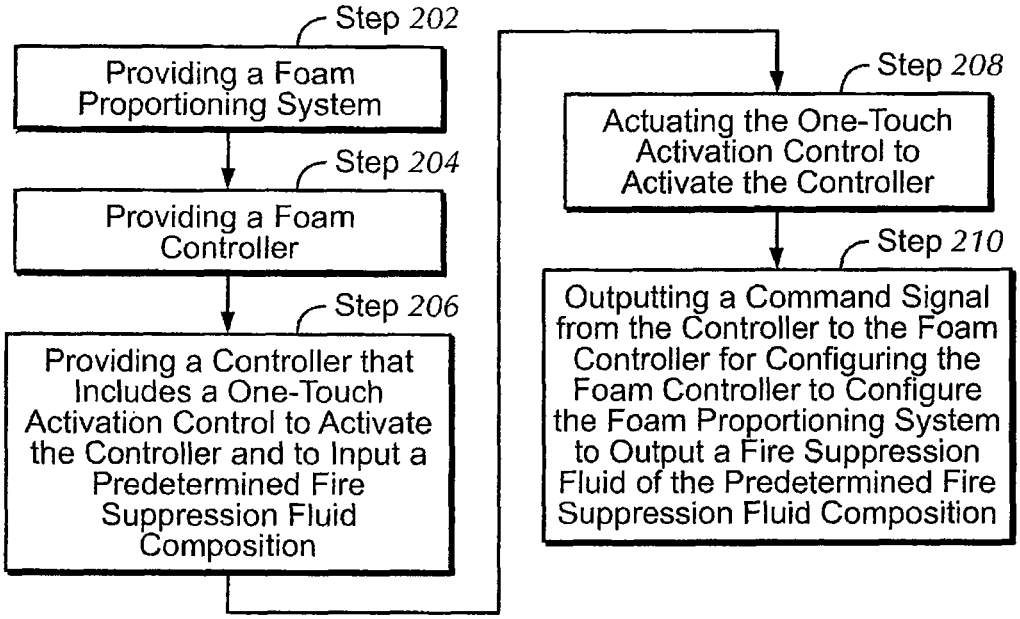
FIG. 14 is a flow chart of a method of proportioning foam in accordance with a further preferred embodiment of the present invention.

The present invention further provides for a method of proportioning foam for the fire suppression system described above. In particular, the method includes the steps as illustrated in the flowchart on FIG. 14. First, the foam proportioning system 40 is provided (Step 202). Then the foam controller 54 is provided that is operatively connected to the foam proportioning system 40 (Step 204). Thereafter, the controller 44, which includes a one-touch activation control 44*a* to activate the controller 44 and for inputting a predetermined fire suppression fluid composition, is provided (Step 206). The controller 44 is operatively connected to the foam controller 54. Actuation of the one-touch activation control 44*a* activates the controller 44. Upon actuation of the one-touch activation control 44*a* (Step 208), the controller 44 outputs a command signal to the foam controller 54 for configuring the foam controller 54 to configure the foam proportioning system 40 to output a fire suppression fluid having the predetermined fire suppression fluid composition (Step 210).

Figure 15:
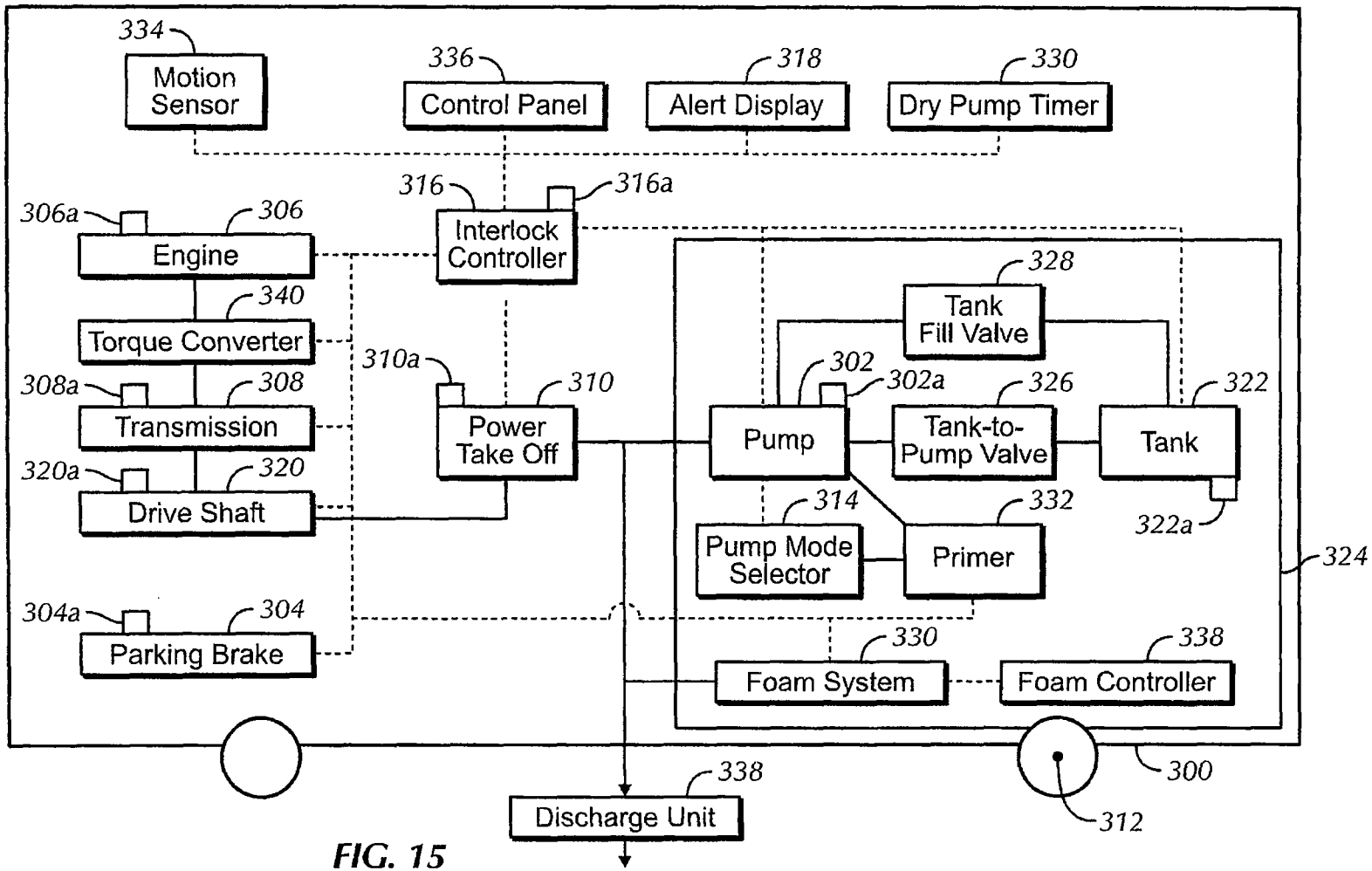
FIG. 15 is a schematic block diagram of a fire suppression system in accordance with another preferred embodiment of the present invention.

In yet another embodiment of the present invention, there is provided an integrated control system for a fire truck 300, as shown in FIG. 15. The fire truck 300 includes a tank sensor 322*a* for sensing the contents of a tank 322 within the fire truck 300, an engine 306 having at least a low gear and a high gear for driving the fire truck 300 and an engine sensor 306*a*, a torque converter 340 operatively connected to the engine 306, a transmission sensor 308*a* for sensing engagement of a transmission 308 operatively connected to the torque converter 340, a drive shaft sensor 320*a* for sensing rotation of a drive shaft 320 operatively connected to the transmission 308, a pump 302 having at least one pump mode for pumping a fire suppression fluid, and a pump sensor 302*a* for sensing operation of the pump 302, a plumbing assembly 324 operatively connected to the pump 302 and the tank 322, the plumbing assembly 324 including a tank-to-pump valve 326 and a tank fill valve 328, a foam system 330 connected to the plumbing assembly 324, a parking brake sensor 304*a* for sensing engagement of a parking brake 304, a power take off sensor 310*a* for sensing engagement of a power take off system 310 that diverts engine power from the transmission 308 to the pump 302, an alert display 318 for communicating one or more alerts, a dry pump timer 330 for timing an operation of the pump, a primer 332 for priming the pump 302, a motion sensor 334 for sensing motion of the fire truck 300, a control panel 336 for receiving inputs from a user, and a foam controller 338 for controlling the foam system. Such sensors described above and applicable to the present invention are well known to those skilled in the art. As such, a detailed description of them is not necessary for a complete understanding of the present invention. Furthermore, such sensors can be those already part of the fire truck's transmission control unit, vehicle bus, and/or controller area network.

Figure 16:
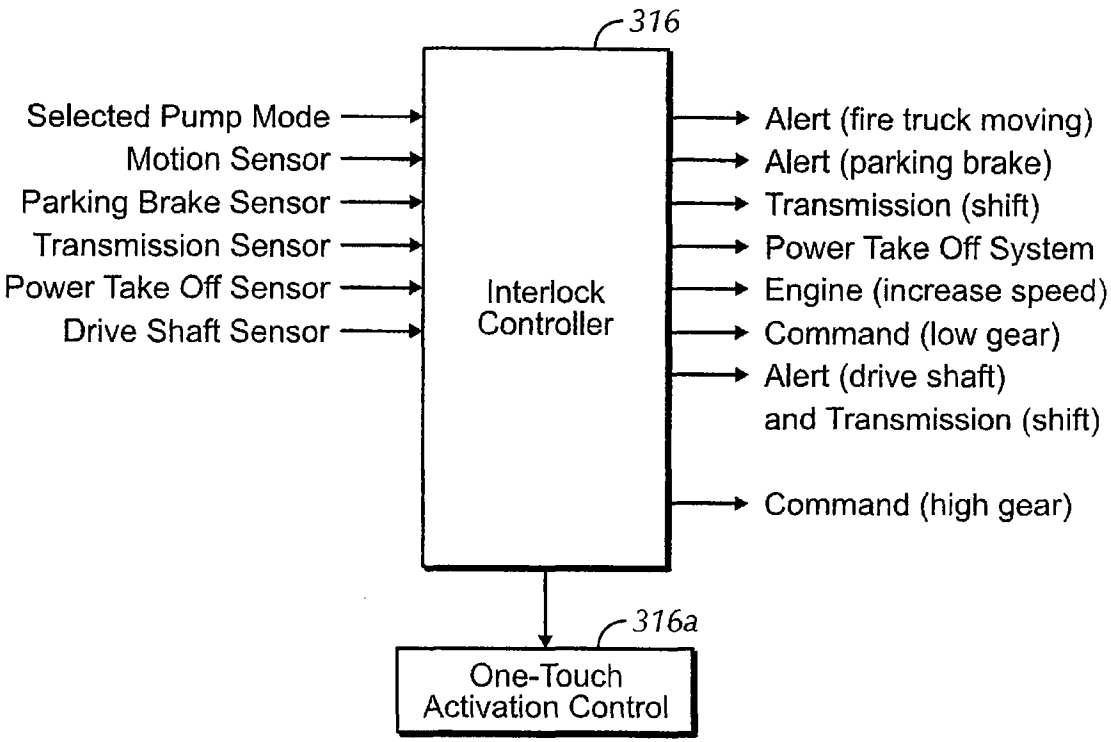
FIG. 16 is a schematic block diagram of a controller in accordance with the fire suppression system of FIG. 15.

The fire truck 300 also includes a interlock controller 316 having a one-touch activation control 316*a* similarly configured as described in the above embodiments. The interlock controller 316 is operatively connected to the one-touch activation control 316*a*, the alert display 318, the dry pump timer 330, the engine 306, the parking brake sensor 304*a*, the transmission sensor 308*a*, the torque converter 340, the drive shaft sensor 320*a*, the power take off sensor 310*a*, the primer 332, the pump 302, the tank sensor 322*a*, the tank fill valve 328, the motion sensor 334, the pump sensor 302*a*, the control panel 336 and the foam controller 338. FIG. 16 illustrates on overview block diagram of the operational function of the interlock controller 316.

Figure 17:
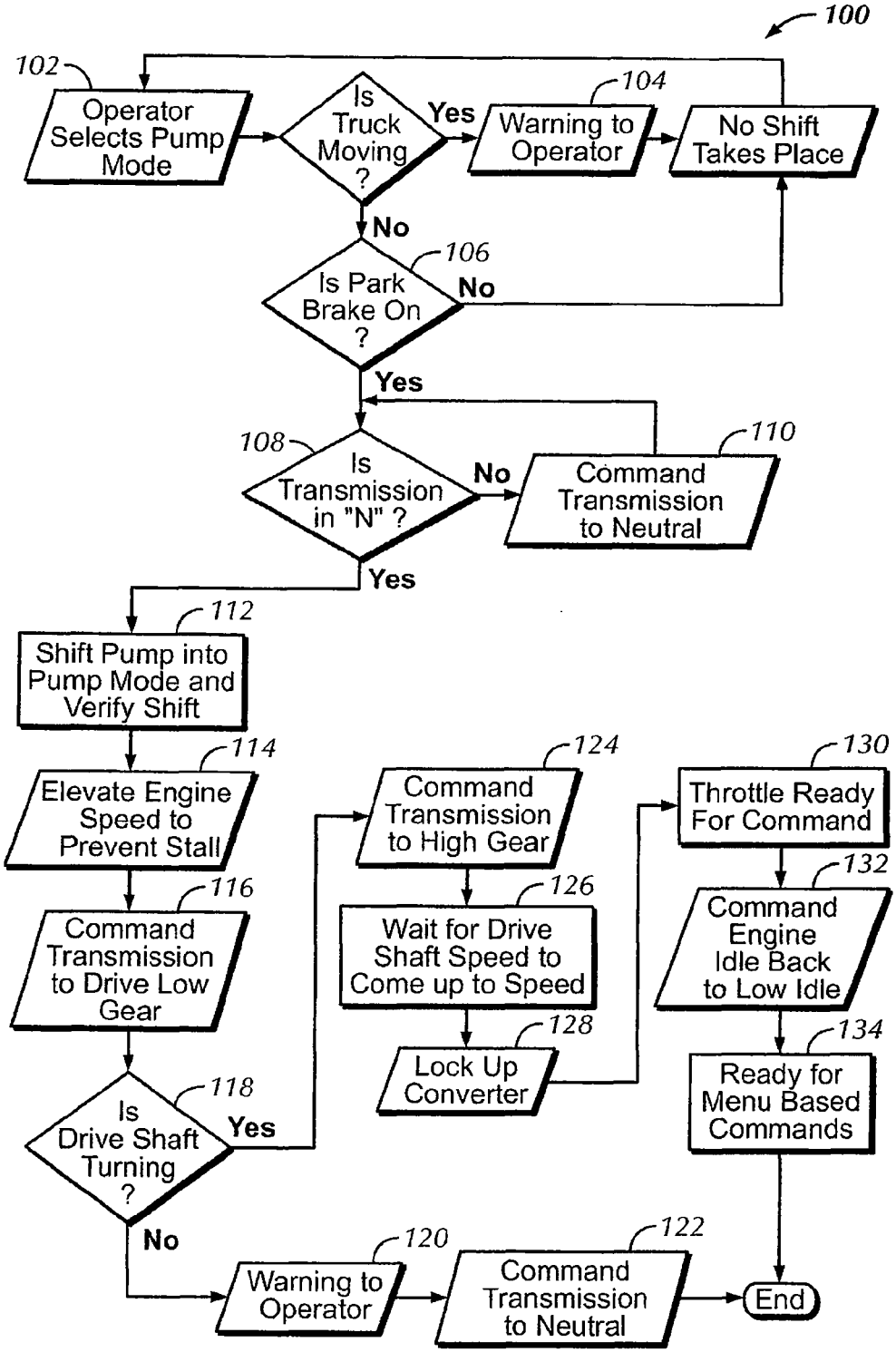
FIG. 17 is a flow diagram of a one-touch activation interlock and automated pump shift sequence system of the fire suppression system of FIG. 15.

FIG. 17 illustrates a flow diagram of the operational function of the interlock controller 316 configured as a one-touch activated interlock and automated pump shift sequence system 100. The interlock and automated pump shift sequence controlled by the interlock controller 316 is generally designated 100. The interlock controller 316 (via the interlock and automated pump shift sequence system 100) automatically ensures that the parking brake 302 is on and that the fire truck transmission 308 is in "neutral" before making the shift of engine power to the pump 302 and returning the fire truck transmission 308 to "drive." The one-touch activated interlock and automated pump shift sequence system 100 is used in a split shaft power take-off (PTO) system 310 that diverts the engine power of the fire truck 300 from the wheels to the fire pump 302. The split shaft PTO system 310, which may be the most commonly used method of driving large fire pumps in the world, is a shiftable pump gearbox. The fire truck transmission 308 drives the pump in a high gear ratio e.g., 1:1, and locks a torque converter 340 to prevent slippage and heat build-up. Locking the torque converter 340 eliminates its torque multiplication and as a result, advantageously helps prevent stalling of the pump 302 if the engine 306 of the fire truck 300 were left in the "road" position.

The process of an integrated shift for conventional fire suppression systems includes increasing the engine speed to prevent engine stalling when e.g., a decrease in pump pressure has occurred as a result of air within the hose. This has become an important aspect of fire suppression systems in recent years due to modern emissions controls, which requires the restriction of the slew rate on fuel injection to prevent smoke. This works to limit smoke exhaust, but it also reduces the engine's ability to react to torque increases. Fire pumps, particularly large fire pumps, have significant inertia and this inertia is applied suddenly when the fire truck transmission is placed in gear and the torque converter is locked up. This can cause the engine to stumble and stall, especially in cold climates and higher elevations. Thus, conventional integrated shift sequences are less reliable for emergency operations.

Referring to FIGS. 15 and 17, in operation, the fire suppression system or fire truck 300 is taken or driven to the scene of the fire. Once the fire truck 300 arrives at the emergency scene, the user or firefighter selects the desired mode of the pump 102. If the fire truck 300 is in motion, a warning message (alert) 104 is sent to the alert display 318 to alert the operator and the shift of engine power from the drive axle 312 of the fire truck 300 to the fire pump 302 is prevented. It is understood by those skilled in the art that the warning message can be in virtually any form, such as an audible alert or as a visual alert to an alert display 318 or on one of the control panels 70, 70', 70", for example. As used herein, an alert display 318 can display a visual alert, output an audible alert, or otherwise communicate any other form of alert. As seen in FIG. 17, the interlock and automated pump shift sequence continues until the fire truck 300 has come to a complete stop. Once the fire truck 300 has stopped moving the interlock and automated shift sequence system 100 determines if the parking brake 304 of the fire truck 300 is engaged 106. If the parking brake 304 is not engaged, the shift of the engine power from the rear axle 312 to the fire pump 302 does not take place.

Alternatively, if the parking brake 304 of the fire truck 300 is engaged, the one touch activated interlock and automated pump shift sequence system 100 determines if the drive transmission 308 of the fire truck is in the "neutral" position 108 via the transmission sensor 308*a*. If the drive transmission 308 is not in "neutral", the one touch interlock and automated pump shift sequence system 100 sends a command via the interlock controller 316 to automatically put the transmission into "neutral" 110. The interlock controller 316 can be any suitable controller, such as a controller area network (CAN) e.g., an SAE J1939 data, or any other controller capable of transmitting and receiving data without departing from the spirit and scope of the present invention. A CAN, however is preferably employed since fire suppression systems have considerable variation as individual users have their own conditions and requirements and a CAN is relatively reliable and simple to configure and build. Further, a CAN arrangement also makes it easier to add features and/or modules to the fire suppression system. However, it is understood by those skilled in the art that the valves, controls and the engine can be individually wired, as well.

If the drive transmission 308 is in "neutral," the interlock and automated pump shift sequence system 100 shifts the fire pump 302 into a "pump mode" and verifies that the shift has been properly completed 112. Next, the interlock and automated shift sequence system 100 elevates the engine speed via the interlock controller 316, to prevent the engine 306 from stalling 114. The interlock controller 316 then commands the drive transmission 308 to drive in a low gear. If the drive shaft 320 of the fire truck transmission 308 does not begin to turn or rotate 118, an alert signal is sent to the alert display 318 to alert the operator 120 and the interlock controller 316 commands the drive transmission 308 to "neutral." At this point, if the operator desires to continue the interlock and shift sequence, the operator must re-select the pump mode 102 at the beginning of the one-touch activated interlock and automated shift sequence system 100.

However, if the drive shaft 320 of the fire truck 300 is turning or begins to turn, the interlock and automated pump shift sequence system 100 automatically commands the transmission 308 to a high gear via interlock controller 316. After waiting for a predetermined time period to allow the drive shaft 320 to reach the proper rotational speed 126, the interlock controller 316 locks-up the torque converter 340. At this point, a throttle is ready for a command from the user or firefighter 130. Once the desired operation of the pump 302 has occurred, the interlock controller 316 commands the engine 306 to revert to a low idle 132. At this point, the interlock and automated shift sequence system 100 is ready for the above described menu based commands 134. It is understood by those skilled in the art that once operation of the pump 302 has completed, the interlock and automated pump shift sequence system 100 may automatically place the truck transmission 308 into "neutral", allow the driveshaft 320 to stop, then shift the pump transmission 308 back to "drive" so that the truck 300 can be driven again.

In sum, the interlock controller 316 is configured to receive an input signal of the selected pump mode from the pump 302 (or pump mode selector 314) and an input signal from the motion sensor 334. The motion sensor 334 indicates if the fire truck 300 is in motion when the interlock controller 302 receives the input signal of the selected pump mode. An alert signal is then outputted by the interlock controller 316 to the alert display 318 if the fire truck 300 is determined to be in motion. The interlock controller 316 also receives an input signal from the parking brake sensor 304*a* which indicates if the parking brake 304 is engaged when the fire truck 300 is not in motion. When the interlock controller 316 determines that the parking brake is disengaged, an alert signal is outputted to the alert display 318. The interlock controller 316 then receives an input signal from the transmission sensor 308*a* that indicates if the transmission 308 is in neutral when the parking brake 304 is determined to be engaged. When the transmission 308 is determined to not be in neutral, the interlock controller 316 outputs a command signal to the transmission 308 to shift the transmission 308 into neutral. The interlock controller 316 then outputs a command signal to the power take off system 310 to activate the power take off system 310 to shift engine power from the transmission 308 to the pump 302 so as to enable operation of the selected pump mode when the transmission 308 is determined to be in neutral. The interlock controller 316 then receives an input signal from the power take off sensor 310*a* to verify that the power take off system 310 has shifted engine power to the pump 302 and then outputs a command signal to the engine 306 to increase engine speed and a command signal to the transmission 308 to drive the engine 306 in the low gear. An input signal from the drive shaft sensor 320*a* is then received that indicates if the drive shaft 320 of the transmission 308 is rotating after the command signal to drive the engine 306*a* in the low gear has been outputted. Then, when the drive shaft 320 is determined to be stationary, the interlock controller 316 outputs an alert signal to the alert display 318 and a command signal to the transmission 308 to shift the transmission 308 to neutral when the drive shaft 320 is determined to be stationary. The interlock controller 316 then outputs a command signal to the engine 306 to drive the engine 306 in the high gear when the drive shaft 320 is determined to be rotating and outputs a command signal to the torque converter 340 to lock the torque converter 340 in gear.

Figure 18:
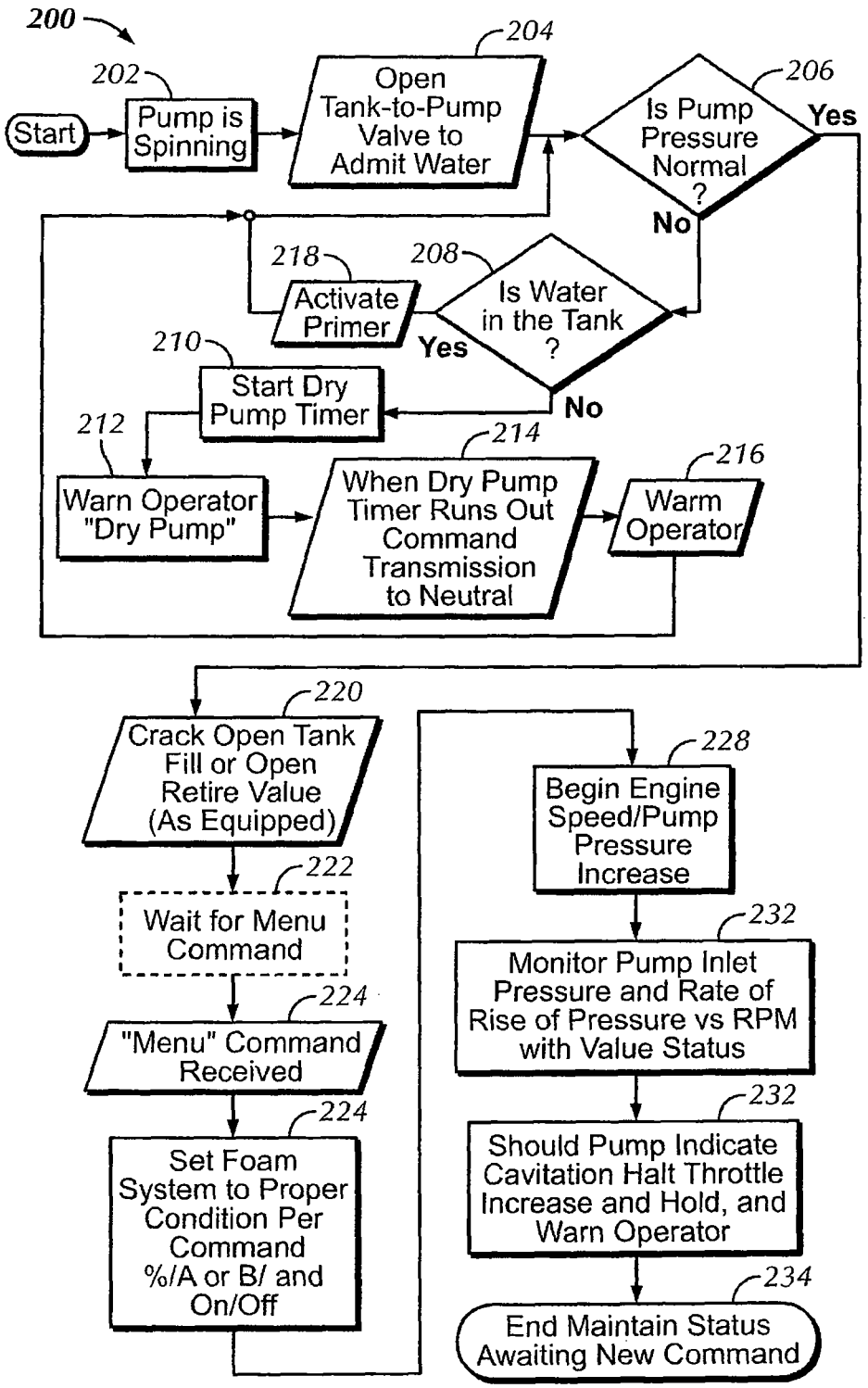
FIG. 18 is a flow diagram of a one-touch activation automated pump/engine throttle-up sequence system of the fire suppression system of FIG. 15.

Referring now to FIG. 18, there is shown a flow diagram of an automated pump/engine throttle-up sequence, generally designated 200, in accordance with another aspect of the present invention. Preferably, the automated pump/engine throttle-up sequence 200 is designed to automatically begin once the one-touch activated interlock and automated pump shift sequence system 100 has completed. However, it is understood by those skilled in the art that the automated pump/engine throttle-up sequence 200 may be designed to work in conjunction with the one-touch activated interlock and automated pump shift sequence system 100 and automatically begin to operate once the pump 302 is spinning or turning.

Referring now to FIGS. 15 and 18, in operation, the automated pump/engine throttle-up sequence 200, controlled by the interlock controller 316, begins to operate once the fire truck 300 or fire suppression system is at the scene of the fire and the pump 302 is already spinning or in operation 202. Next, per the sequence 200 the tank-to-pump valve automatically opens 326 within the fire suppression system to admit the flow of water therein 204. If in the sequence 200, the pump pressure is detected to not be normal 206, the interlock controller 316 checks to determine 208 if there is water in the tank 322.

If there is no water in the tank 322, a dry pump timer 330 automatically starts and sends the user or firefighter a warning 212 via the interlock controller 316 that the pump 302 is dry or is lacking water. Once the dry pump timer 330 times out, the interlock controller 316 commands the transmission 308 to "neutral" 214 and sends a second warning 216 to the user or firefighter. At this point of the sequence 200 the pump pressure is again checked to determine if the pressure is normal 206. If there is water in the tank 322, the interlock controller 316 activates a primer 332 and then checks again to determine if the pump pressure is normal 206.

However, if the pump pressure is normal 206, the interlock controller 316 automatically opens 220 the tank fill valve 328 or a recirculation valve (not shown), depending on the type or model of fire suppression system or fire truck 300 being used. At this point of the sequence 200, the interlock controller 316 waits for a "menu command" or user input 222 from the firefighter as described above. Once the "menu command" is received 224, the interlock controller 316 automatically sets 226 the foam system 330 to the proper conditions per the command. For example, the foam system 330 may be turned on or off, or the foam percentage or foam type may be adjusted. Next, the interlock controller 316 begins to increase the engine speed/pump pressure. Meanwhile, the interlock controller 316 monitors the pressure at the pump 302 inlet and rate at which the pressure rises versus the revolutions per minute (rpm) of the engine 306 with valve status 230. If at, any point, the interlock controller 316 detects cavitation, the interlock controller 316 stops throttle increases of the engine 306 and holds the throttle at the present rate. Further, a warning 232 is sent to the user or firefighter. At this point of the sequence 200, the interlock controller 316 maintains the current status and awaits a new command from the firefighter.

Figure 19:
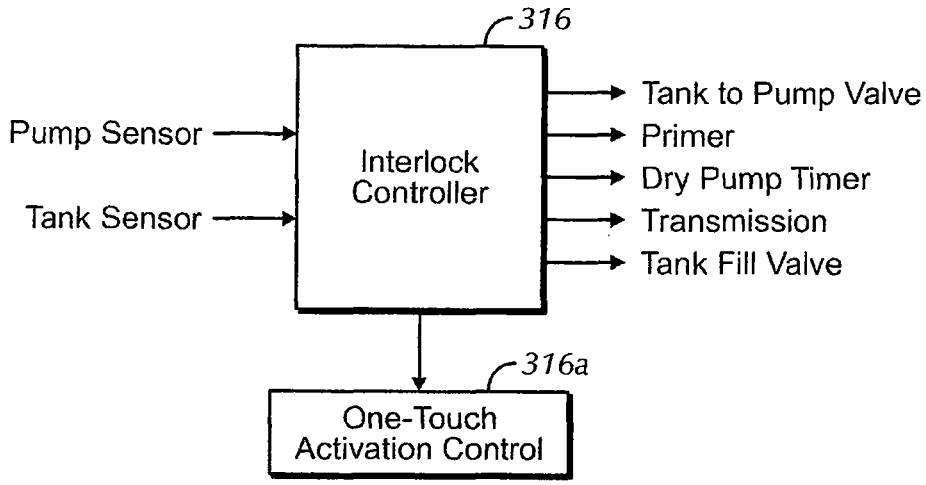
FIG. 19 is a schematic block diagram of another aspect of the controller in accordance with the fire suppression system of FIG. 15.

In sum, this aspect of the invention is shown schematically in FIG. 19. In particular, the interlock controller 316 is further configured to receive an input signal from the pump sensor 302*a* indicating if the pump 302 is pumping and to output a command signal to the tank-to-pump valve 326 to open so as to allow the fire suppression fluid to enter the pump 302 when the pump 302 is determined to be pumping. The interlock controller 316 then determines if the pump 302 is producing a pump pressure sufficient to fill the tank 322. An input signal from the tank sensor 322*a* is then received to indicate if the tank 322 is empty when the pump 302 is determined to produce insufficient pump pressure. When the tank 322 is determined not to be empty, the interlock controller 316 outputs a command signal to the primer 332 to activate. The interlock controller 316 then outputs a command signal to the dry pump timer 330 to automatically start and then outputs an alert signal to the alert display 318 that the pump 302 is dry when the tank 322 is determined to be empty. Then, the interlock controller 316 outputs a command signal to the transmission 308 to shift the transmission 308 into neutral once the dry pump timer 330 times out and then outputs a second alert signal to the alert display 318 that the pump 302 is dry. When the pump 302 is determined to produce a pump pressure sufficient to fill the tank 322, the interlock controller 316 outputs a command signal to the tank fill valve 328 to open.

Figure 20:
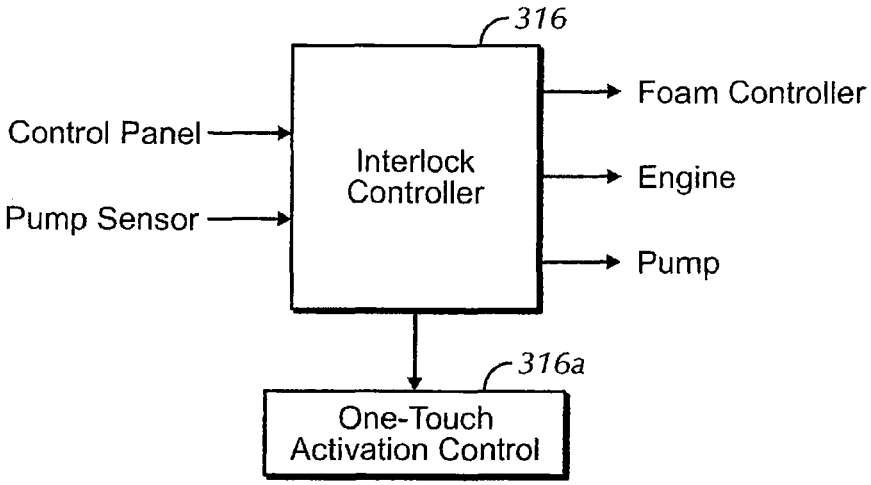
FIG. 20 is a schematic block diagram of yet another aspect of the controller in accordance with the fire suppression system of FIG. 15.

In addition, as shown schematically in FIG. 20, the interlock controller 316 can furthermore be configured to receive an input command from the control panel 336 and output to the foam controller 338 inputs for configuring the foam system 330 to output a predetermined fire suppression fluid composition that corresponds with the inputted command. Once the foam controller 338 has received the predetermined fire suppression fluid composition, the interlock controller 316 outputs a command signal to the engine 306 and the pump 302 to increase engine speed and pump pressure. The interlock controller 316 then receives an input signal from the pump sensor 302*a* that indicates if a cavitation is sensed and then outputs a command signal to the engine 306 and the pump 302 to halt increases in engine speed and pump pressure when cavitation is detected and an alert signal to the alert display indicating the presence of a cavitation.

Figure 22:
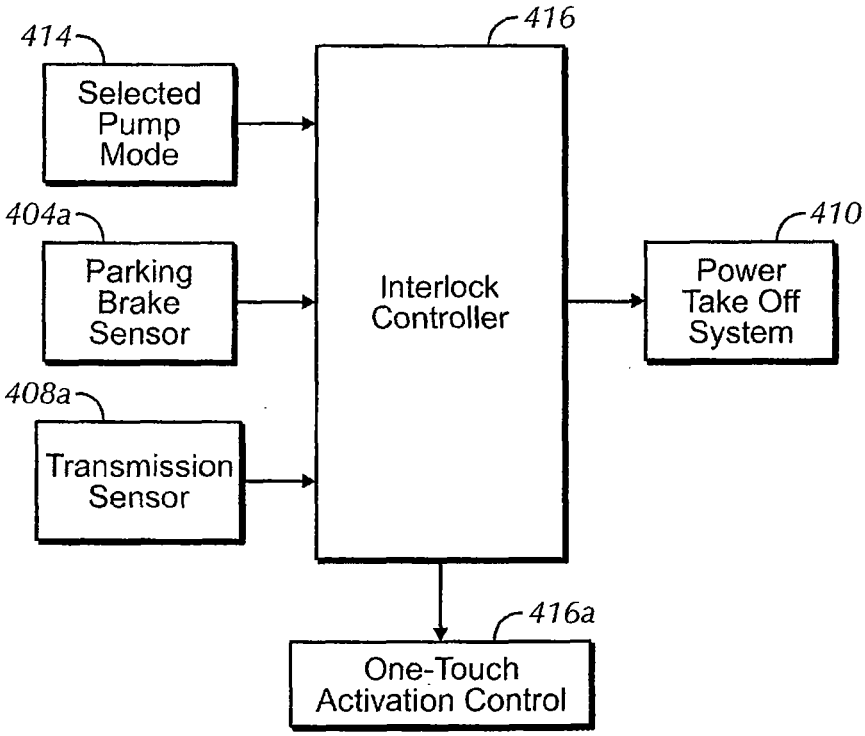
FIG. 22 is a schematic block diagram of a controller in accordance with the fire suppression system of FIG. 21.
Figure 21:
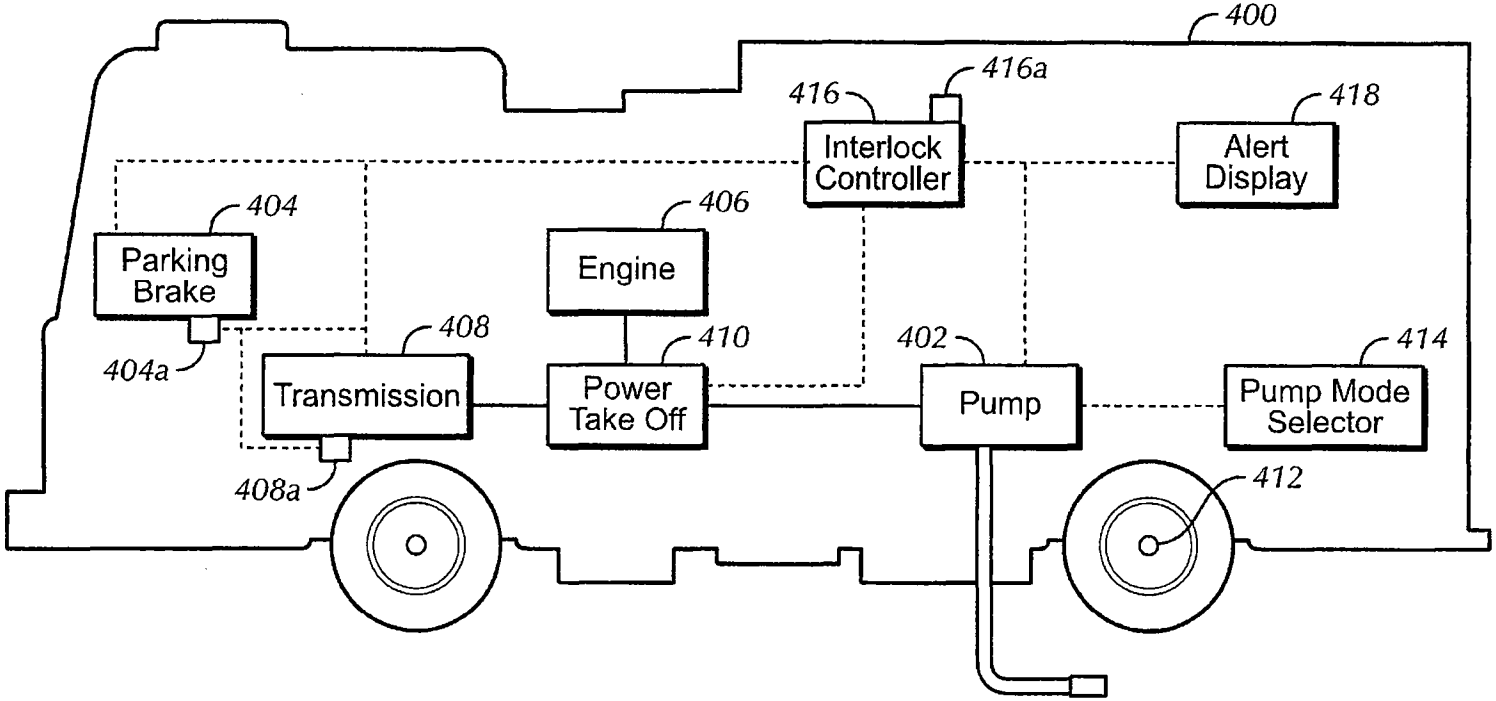
FIG. 21 is a schematic block diagram of a fire suppression system in accordance with a further preferred embodiment of the present invention.

In a further embodiment, the present invention provides for an integrated control system having an interlock controller 416 for a fire truck 400, as shown schematically in FIGS. 21 and 22. The fire truck 400 includes a pump 402 having at least one pump mode for pumping a fire suppression fluid, a parking brake 404 and a parking brake sensor 404*a* for sensing engagement of the parking brake 404, an engine 406 for driving the fire truck 400, a transmission 408 and a transmission sensor 408*a* for sensing engagement of the transmission 408, and a power take off system 410 for diverting engine power from a drive axle 412 of the fire truck 400 to the pump 402. The pump 402 also includes a pump mode selector 414 for selecting at least one pump mode. The fire truck 400 also includes a interlock controller 416 having a one-touch activation control 416*a* similarly configured as described in the above embodiments.

The interlock controller 416 is operatively connected to the pump 402, the parking brake sensor 404*a*, the transmission sensor 408*a* and the power take off system 410. The interlock controller 416 also includes the one-touch activation control 416*a* that is operatively connected to the interlock controller 416 for activating the interlock controller 416.

Upon activation of the one-touch activation control 416*a*, the interlock controller 416 receives various input signals. In particular, the interlock controller 416 receives input signals of a selected pump mode from the pump 402, from the parking brake sensor 408*a* indicating if the parking brake 404 is engaged, and from the transmission sensor 408*a* indicating if the transmission 408 is in neutral. The input signal from the parking brake sensor 408*a* can be received when the input signal of the selected pump mode is received. The interlock controller 416 then determines if the parking brake 404 is engaged and if the transmission 408 is in neutral. Only when the parking brake 404 is engaged and the transmission 408 is in neutral, the interlock controller 416 outputs a command signal to activate the power take off system 410 so as to shift engine power from the transmission 408 to the pump 402 to enable operation of the selected pump mode.

Figure 23:
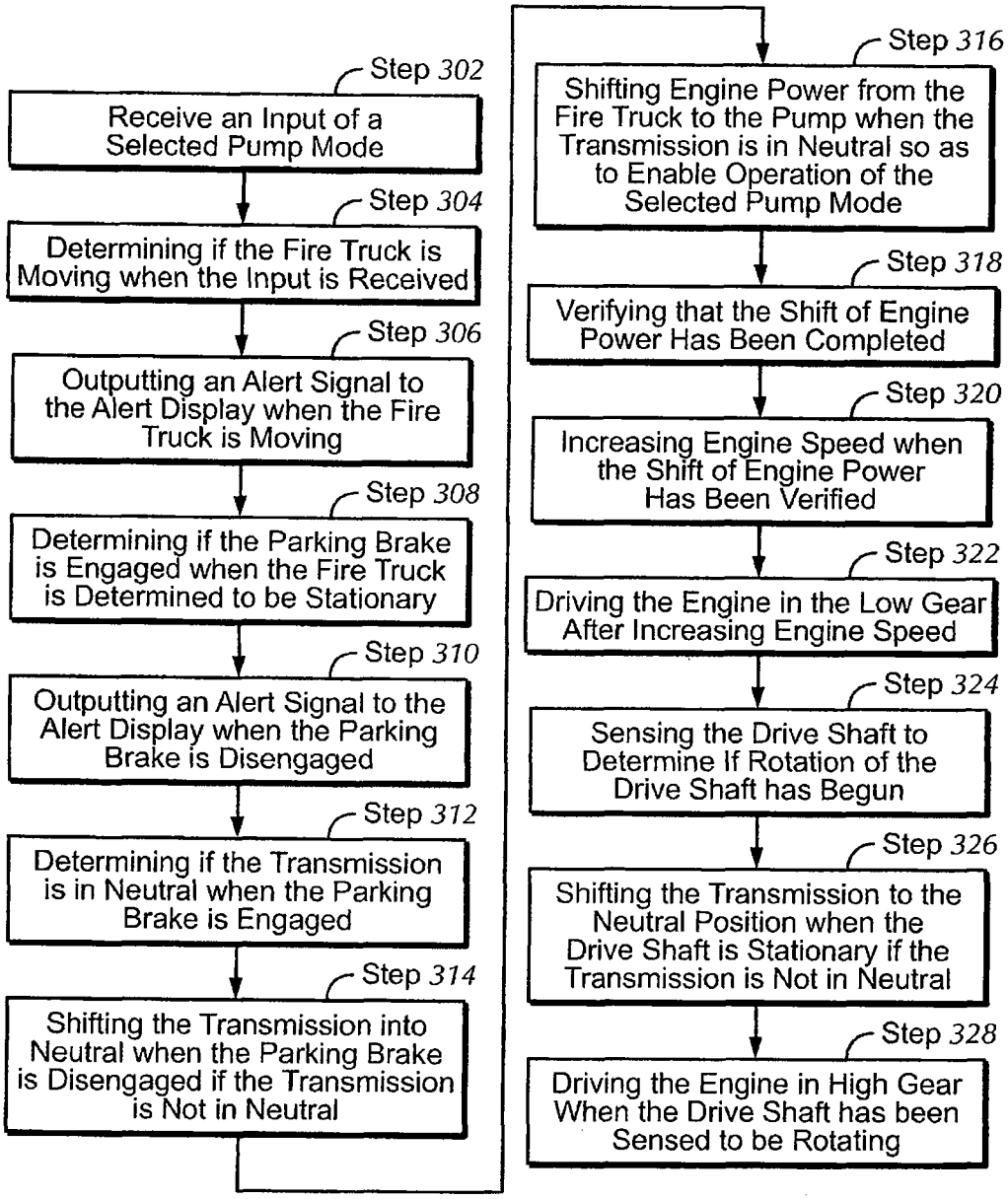
FIG. 23 is a flow chart of a method of operating an interlock and pump shift for a fire truck in accordance with yet another preferred embodiment of the present invention.

The present invention also provides for a method of operating an interlock and pump shift, as shown in the flowchart of FIG. 23, for a fire truck substantially configured as shown in FIG. 15. In particular, the fire truck 300 includes a tank 322 for holding a fire suppression fluid, a pump 302 having at least one pump mode for pumping the fire suppression fluid, a plumbing assembly 324 operatively connected to the pump 302, the tank 322, and the fire truck 300, the plumbing assembly 324 having a tank-to-pump valve 326 and a tank fill valve 328, a foam system 330 connected to the plumbing assembly 324, a parking brake 304 for maintaining the fire truck 300 in park, an engine 306 having a low gear and a high gear for driving the fire truck 300, a torque converter 340 operatively connected to the engine 306, a transmission 308 operatively connected to the torque converter 340, a drive shaft 320 operatively connected to the transmission 308, a power take off system 310 operatively connected to the transmission 308 for diverting engine power from a drive axle 312 of the fire truck 300 to the pump 302, and an alert display 318 for communicating one or more alerts.

In operation of the interlock and pump shift for the fire truck 300, an input of a selected pump mode from a user, such as a fire fighter, is initially received (Step 302). When the input of the selected pump mode is received, it is then determined if the fire truck 300 is moving or not (Step 304). When the fire truck 300 is determined to be moving, an alert signal is outputted to, for example an alert display 318 (Step 306). However, when the fire truck 300 is determined to be stationary, it is then determined if the parking brake 304 is engaged (Step 308). When the parking braked 304 is disengaged, an alert signal is outputted, for example to the alert display 318 (Step 310). However, when the parking brake 304 is engaged, it is then determined if the transmission 308 is in neutral (Step 312). When the parking brake 304 is disengaged, the transmission 308 is shifted into neutral if the transmission 308 is not already in neutral (Step 314). Then, when the transmission 308 is in neutral, engine power is shifted from the fire truck 300 to the pump 302 so as to enable operation of the selected pump mode (Step 316). Afterwards, the shift of engine power is verified to confirm that the shift has been completed (Step 318). When the shift of engine power has been verified, the engine speed is increased (Step 320). Thereafter, the engine 306 is driven in a low gear (Step 322) and the drive shaft 320 is sensed to determine if rotation of the drive shaft 320 has begun (Step 324). The transmission 308 is then shifted into neutral when the drive shaft 320 is stationary, if the transmission 308 is not already in neutral (Step 326). If the drive shaft 320 has been sensed to be rotating, the engine 306 is then driven in the high gear (Step 328).

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the claims.

We claim:

1. An integrated control system for a fire truck that includes a tank sensor for sensing the contents of a tank within the fire truck, an engine having at least a low gear and a high gear for driving the fire truck and an engine sensor, a torque converter operatively connected to the engine, a transmission sensor for sensing engagement of a transmission operatively connected to the torque converter, a drive shaft sensor for sensing rotation of a drive shaft operatively connected to the transmission, a pump having at least one pump mode for pumping a fire suppression fluid, and a pump sensor for sensing operation of the pump, a plumbing assembly operatively connected to the pump and the tank, the plumbing assembly including a tank-to-pump valve and a tank fill valve, a foam system connected to the plumbing assembly, a parking brake sensor for sensing engagement of a parking brake, a power take off sensor for sensing engagement of a power take off system that diverts engine power from the transmission to the pump, an alert display for communicating one or more alerts, a dry pump timer for timing an operation of the pump, a primer for priming the pump, a motion sensor for sensing motion of the fire truck, a control panel for receiving inputs from a user, and a foam controller for controlling the foam system, the integrated control system comprising:

a one-touch activation control, an interlock controller operatively connected to the one-touch activation control, the alert display, the dry pump timer, the engine, the parking brake sensor, the transmission sensor, the torque converter, the drive shaft sensor, the power take off sensor, the primer, the pump, the tank sensor, the tank fill valve, the motion sensor, the pump sensor, the control panel and the foam controller, and wherein upon actuation of the one-touch activation control on selecting a pump mode the interlock controller is configured to (a) receive an input signal of the selected pump mode from the pump, (b) receive an input signal from the motion sensor indicating if the fire truck is in motion when the input signal of the selected pump mode is received, (c) output an alert signal to the alert display if the fire truck is determined to be in motion, (d) receive an input signal from the parking brake sensor indicating if the parking brake is engaged when the fire truck is not in motion, (e) output an alert signal to the alert display if the parking brake is determined to be disengaged, (f) receive an input signal from the transmission sensor indicating if the transmission is in neutral when the parking brake is determined to be engaged, (g) output a command signal to the transmission to shift the transmission into neutral when the transmission is determined to not be in neutral, (h) output a command signal to the power take off system to activate the power take off system to shift engine power from the transmission to the pump so as to enable operation of the selected pump mode when the transmission is determined to be in neutral, (i) receive an input signal from the power take off sensor to verify that the power take off system has shifted engine power to the pump and then output a command signal to the engine to increase engine speed, (j) output a command signal to the transmission to drive the engine in the low gear, (k) receive an input signal from the drive shaft sensor indicating if the drive shaft of the transmission is rotating after the command signal to drive the engine in the low gear has been outputted, (l) output an alert signal to the alert display and a command signal to the transmission to shift the transmission to neutral when the drive shaft is determined to be stationary, and (m) output a command signal to the engine to drive the engine in the high gear when the drive shaft is determined to be rotating and output a command signal to the torque converter to lock the torque converter in gear.

2. The integrated control system of claim 1, wherein the interlock controller is further configured to (n) receive an input signal from the pump sensor indicating if the pump is pumping, (o) output a command signal to the tank-to-pump valve to open the tank-to-pump valve to allow fire suppression fluid to enter the pump when the pump is determined to be pumping, (p) determine if the pump is producing a pump pressure sufficient to fill the tank, (q) receive an input signal from the tank sensor indicating if the tank is empty when the pump is determined to produce insufficient pump pressure, (r) output a command signal to the primer to activate the primer when the tank is determined to not be empty, (s) output a command signal to the dry pump timer to automatically start and then output an alert signal to the alert display that the pump is dry when the tank is determined to be empty, (t) output a command signal to the transmission to shift the transmission into neutral once the dry pump timer times out and then output a second alert signal to the alert display that the pump is dry, (u) output a command signal to the tank fill valve to open the tank fill valve when the pump is determined to produce a pump pressure sufficient to fill the tank.

3. The integrated control system of claim 2, wherein the interlock controller is further configured to (v) receive an input command from the control panel, (w) output to the foam controller inputs for configuring the foam system to output a predetermined fire suppression fluid composition that corresponds with the inputted command, (x) output a command signal to the engine and the pump to increase engine speed and pump pressure after the foam controller has received the predetermined fire suppression fluid composition, (y) receive an input signal from the pump sensor indicating if a cavitation is sensed, and (z) output a command signal to the engine and the pump to halt increases in engine speed and pump pressure when cavitation is detected and output an alert signal to the alert display.

4. A method of operating an interlock and pump shift for a fire truck that includes a tank for holding a fire suppression fluid, a pump having at least one pump mode for pumping the fire suppression fluid, a plumbing assembly operatively connected to the pump, the tank, and the fire truck, the plumbing assembly having a tank-to-pump valve and a tank fill valve, a foam system connected to the plumbing assembly, a parking brake for maintaining the fire truck in park, an engine having a low gear and a high gear for driving the fire truck, a torque converter operatively connected to the engine, a transmission operatively connected to the torque converter, a drive shaft operatively connected to the transmission, a power take off system operatively connected to the transmission for diverting engine power from a drive axle of the fire truck to the pump, and an alert display for communicating one or more alerts, the method comprising the steps of:

receiving an input of a selected pump mode;

determining if the fire truck is moving when the input is received;

outputting an alert signal to the alert display when the fire truck is moving;

determining if the parking brake is engaged when the fire truck is determined to be stationary;

outputting an alert signal to the alert display when the parking brake is disengaged;

determining if the transmission is in neutral when the parking brake is engaged;

shifting the transmission into neutral when the parking brake is disengaged if the transmission is not in neutral;

shifting engine power from the fire truck to the pump when the transmission is in neutral so as to enable operation of the selected pump mode;

verifying that the shift of engine power has been completed;

increasing engine speed when the shift of engine power has been verified;

driving the engine in the low gear after increasing engine speed;

sensing the drive shaft to determine if rotation of the drive shaft has begun;

shifting the transmission to the neutral position when the drive shaft is stationary if the transmission is not in neutral; and driving the engine in the high gear when the drive shaft has been sensed to be rotating.

* * * * *